US007122298B2

(12) United States Patent
Matsuda

(10) Patent No.: US 7,122,298 B2
(45) **Date of Patent: *Oct. 17, 2006**

(54) SILVER HALIDE PHOTOGRAPHIC PHOTOSENSITIVE MATERIAL

(75) Inventor: Naoto Matsuda, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/088,935

(22) Filed: Mar. 25, 2005

(65) Prior Publication Data

US 2005/0214697 A1 Sep. 29, 2005

(30) Foreign Application Priority Data

Mar. 25, 2004 (JP) ..... 2004-090399

(51) Int. Cl.
*G03C 1/46* (2006.01)

(52) U.S. Cl. ..... 430/502; 430/546; 430/631; 430/634; 430/635

(58) Field of Classification Search ..... 430/502, 430/631, 634, 635, 546
See application file for complete search history.

(56) References Cited

U.S. PATENT DOCUMENTS 5,932,401 A 8/1999 Chen
6,994,953 B1 2/2006 Matsuda et al.
2005/0042557 A1* 2/2005 Matsuda et al. ..... 430/502

FOREIGN PATENT DOCUMENTS

| | | |
|---|---|---|
| EP | 0 182 658 A2 | 5/1986 |
| JP | 2-272450 A | 11/1990 |
| JP | 04-080751 A | 3/1992 |
| JP | 8-328212 A | 12/1996 |
| JP | 11-119398 A | 4/1999 |

* cited by examiner

*Primary Examiner*—Geraldine Letscher
(74) *Attorney, Agent, or Firm*—Sughrue Mion, PLLC

(57) ABSTRACT

There is provided a silver halide photographic photosensitive material, containing a support and at least one photosensitive silver halide emulsion layer on the support, the silver halide photographic photosensitive material, further including at least one layer containing an emulsion having at least one surfactant represented by the formula (I), in which the photosensitive material contains a substantially non-color-forming photosensitive emulsion layer. The formula (I) is indicated as $(R_1—L)_n$-J-$(A)_m$. In the formula: A represents an acid group or a metal salt thereof; $R_1$ represents an aliphatic group; L represents a divalent group; J represents a linking group, having a valence of n plus m, which links $R_1$—L and A; n represents a natural number of from 1 to 6; and m represents a natural number of from 1 to 3.

12 Claims, No Drawings

SILVER HALIDE PHOTOGRAPHIC PHOTOSENSITIVE MATERIAL

CROSS-REFERENCE TO RELATED APPLICATION

This application claims priority under 35USC 119 from Japanese patent application No. 2004-090399, the disclosure of which is incorporated herein by reference.

BACKGROUND OF THE INVENTION

1. Field of the Invent

The present invention relates to a silver halide photographic photosensitive material and, particularly, to a silver halide color photographic photosensitive material which is excellent in color reproduction properties and with reduced generation of unevenness in developing processing.

2. Description of the Related Art

Various types of attempts have been made to provide color photographic photosensitive materials with improved color reproduction properties. In the case of a color negative film, in order to attain higher color saturation and more faithful color reproduction, correction of secondary absorption of coloring materials has ordinarily been made by masking, in which a so-called colored coupler is used. On the other hand, in the case of color reversal photographic photosensitive materials, the above-mentioned correction of the secondary absorption of the coloring material by means of masking using colored couplers cannot be carried out. Accordingly, attempts to improve the color reproduction properties have been made, mainly by making use of interimage effects, together with improving spectral sensitivity and spectral absorption characteristics of the coloring materials As methods for improving the interimage effect in color reversal photographic photosensitive materials, a method of providing a new photosensitive emulsion layer (hereinafter, referred to also as "interimage effect imparting layer"), which does not substantially form an image forming dye but exerts the interimage effect on other image forming emulsion layers, is sometimes adopted. For example, examples of color reversal photographic photosensitive materials which are provided with a photosensitive emulsion layer, which does not substantially form a color image after development, and has sensitivity in a cyan to green light region, for the purpose of enhancing the interimage effect mainly for a red sensitive layer are described in JP-A Nos. 2-272450 and 8-328212. Further, a method in which the interimage effect is enhanced by an interimage effect intensifying intercoat layer and/or an interimage effect intensifying overcoat layer, in which a photosensitive emulsion and a non-image forming emulsion containing silver halide grains having an average particle diameter of 0.15 μm or less are blended, is disclosed in JP-A No. 11-119398. These methods are preferable, since the degrees of freedom for design is increased when compared with the design of the interimage effect in the image forming emulsion layers themselves.

However, when the interimage effect was increased by providing an interimage effect intensifying layer, there was a problem in that unevenness during developing processing tends to occur. In ordinary development processing of silver halide color photographic photosensitive materials, the development is performed while a processing solution is replenished in accordance with an area of sensitive material to be processed. However, there is a problem in that foam is generated in the processing solution, due to various types of compounds eluted in the processing solution from the photosensitive material in a running state, and further, processing unevenness occurs due to the resultant foam. It has become a technical problem that processing unevenness, attributable to such foaming of the processing solution as described above, deteriorates by providing an interimage effect intensifying layer and, accordingly, a further improved method has been required.

SUMMARY OF THE INVENTION

The present invention has been made in view of the above circumstances and provides a silver halide photographic photosensitive material, particularly, a silver halide color photographic photosensitive material, which has excellent color reproduction properties and reduced occurrence of unevenness during developing processing.

A first aspect of the invention is to provide a silver halide photographic photosensitive material, comprising a support and at least one photosensitive silver halide emulsion layer on the support, wherein the silver halide photographic photosensitive material comprises at least one layer comprising an emulsion containing at least one surfactant represented by the following formula (I), and wherein the silver halide photosensitive material comprises a substantially non-color forming photosensitive emulsion layer:

$$(R_1\text{—}L)_n\text{-}J\text{-}(A)_m \qquad \text{Formula (I),}$$

wherein A represents an acid group selected from the group consisting of a sulfonic acid, a phosphoric acid and a carboxylic acid and metal salts thereof;

$R_1$ represents an aliphatic group including as a partial structure thereof an aliphatic group whose main chain has at least 6 carbon atoms;

L represents a divalent group;

J represents a linking group, having a valence of n plus m, which links $R_1$—L to A;

n represents a natural number of from 1 to 6; and m represents a natural number of from 1 to 3, wherein, when n represents 2 or more, plural ($R_1$—L) groups present may be the same as each other or different from one another, wherein, when m represents 2 or more, plural A groups present may be the same as each other or different from one another; a sum of carbon atoms of $R_1$ (when n is 2 or more, a sum of the carbon atoms all $R_1$ groups) is 17 or more; and a value obtained by dividing a molecular weight of the surfactant (in the case of a metal salt, the molecular weight obtained by substituting the metal atom with a hydrogen atom) represented by the formula (I) by m is 430 or more.

DETAILED DESCRIPTION OF THE INVENTION

Hereinafter, the present invention is described in detail.

Firstly, a surfactant represented by the following formula (I) is described in detail:

$$(R_1\text{—}L)_n\text{-}J\text{-}A)_m \qquad \text{formula (I),}$$

wherein A represents an acid group selected from the group consisting of a sulfonic acid, a phosphoric acid and a carboxylic acid and metal salts thereof; $R_1$ represents an aliphatic group including as a partial structure thereof an aliphatic group whose main chain has at least 6 carbon atoms; L represents a divalent group; J represents a linking group, having a valence of n plus m, which links $R_1$—L to A; n represents a natural number of from 1 to 6; and m represents a natural number of from 1 to 3. When n represents 2 or more, plural ($R_1$—L) groups present may be the same as each other or different from one another. When m represents 2 or more, plural A groups present may be the same as each other or different from one another. However, a sum of carbon atoms of $R_1$ (when n is 2 or more, a sum of the carbon atoms in all $R_1$ groups) is 17 or more; and a value obtained by dividing a molecular weight of the surfactant (in the case of a metal salt, molecular weight obtained by substituting the metal atom with a hydrogen atom) represented by the formula (I) by m is 430 or more.

First, A in the formula (I) will be described. A represents an acid group selected from the group consisting of a sulfonic acid, a phosphoric acid and a carboxylic acid or a metal salt thereof. Preferably, A is a sulfonic acid or a phosphoric acid and, more preferably, at least one of A's is a sulfonic acid or a metal salt thereof. When A is the metal salt, the metal atom is preferably an alkali metal (for example, lithium, sodium or potassium) or an alkaline earth metal (for example, magnesium or calcium) and, particularly preferably, lithium, sodium or potassium. As for a bond between A and J in the formula (I), when A is a carboxylic acid, A and J are bonded with each other by a carbon atom, but, when A is a sulfonic acid or a phosphoric acid, A and J may be bonded with each other by a sulfur atom or a phosphorous atom, or via an oxygen atom.

$R_1$ represents an aliphatic group containing as a partial structure thereof an aliphatic group whose main chain has at least 6 carbon atoms. As long as the main chain has at least 6 carbon atoms, the main chain may be substituted with a substituent (for example, alkyl group). The aliphatic group containing as a partial structure thereof an aliphatic group whose main chain has at least 6 carbon atoms may be a saturated straight chained alkyl group such as an n-octyl group or an n-dodecyl group and, further, may be a group having an unsaturated bond (a position thereof being not limited; and, in the case of a double bond, either a cis-configuration or a trans-configuration being permissible) within a straight chained group such as oleyl group and, still further, may be a branched chain alkyl group such as 2-n-hexyl-n-nonyl group. Even still further, $R_1$ may be an aliphatic group itself whose main chain has at least 6 carbon atoms. Furthermore, a part or all of hydrogen atoms constituting the aliphatic group may be substituted with a halogen atom (for example, a fluorine atom or a chlorine atom). Still furthermore, a divalent group such as an oxygen atom may be incorporated within the aliphatic group. Even still furthermore, the aliphatic group may have a polymer form, which forms a surfactant represented by the formula (I) as a constituting unit via J.

Among these groups, $R_1$ is preferably an aliphatic group containing as a partial structure thereof an aliphatic group whose main chain has 9 or more carbon atoms and, more preferably, an aliphatic group containing as a partial structure thereof an aliphatic group whose main chain has 12 or more carbon atoms. Further, the upper limit of the carbon atoms in the main chain are preferably 30 or less and, more preferably, 20 or less in all of such cases as described above.

Examples of such groups as described above include n-$C_8H_{17}$, n-$C_9H_{19}$, n-$C_{10}H_{21}$, n-$C_{12}H_{25}$, n-$C_{14}H_{29}$, n-$C_{16}H_{33}$, n-$C_{18}H_{37}$, n-$C_{20}H_{41}$, a 2-ethyl-hexyl group, i-$C_{16}H_{33}$, n-$C_{18}H_{35}$ (containing one double bond in an alkyl chain), $CH_3$—$(CF_2)_4$—$(CH_2)_4$, $CH_3$—$(CF_2)_8$ and $C_{12}H_{25}$—$OC_2H_4$—.

L represents a divalent group. Examples of such groups include —$CHR_2$, —O—, —CO— (bonding may be in either direction), —COO— (bonding may be in either direction), —OCOO—, $CONR_2$— (bonding may be in either direction), —$NR_2CONR_3$—, —$SO_2$—, —$SO_2NR_2$— (bonding may be in either direction), —S—, substituted or unsaturated phenylene and naphthalene groups. $R_2$ and $R_3$ each represent a hydrogen atom or an alkyl group.

Among these groups, L is preferably —$CHR_2$, —O—, —CO— (bonding may be in either direction), —COO— (bonding may be in either direction), $CONR_2$— (bonding may be in either direction).

J represents a linking group of (n+m) valence. Any group is permissible as the linking group as long as it links L to A. Examples of bonding modes among L, J (J-1)

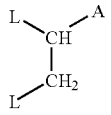

(J-2)

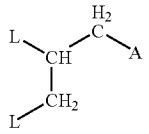

and A include the following configurations:

(J-3)

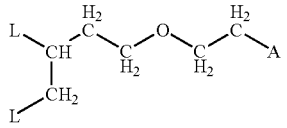

(J-4)

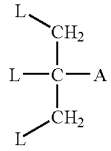

(J-5)

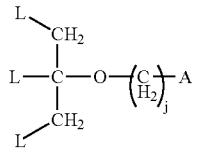

:j represents a natural number of from 1 to 10.

(J-6)

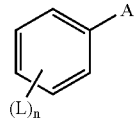

(J-7)

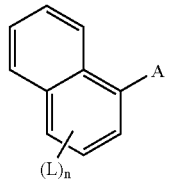

-continued (J-8)

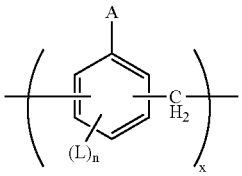

:x represents a natural number of 10 or more.

(J-9)

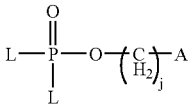

(J-10)

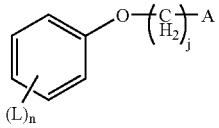

n represents an integer of from 1 to 6 and, preferably, an integer of from 2 to 6, while m represents an integer of from 1 to 3 and, preferably, 1.

In the surfactant represented by the formula (I), a sum of carbon atoms of $R_1$ is 17 or more (preferably from 17 to 70) and, preferably, from 20 to 70 and, more preferably, from 24 to 50.

A value obtained by dividing a molecular weight of the surfactant represented by the formula (I) by m is 430 or more, preferably from 450 to 1000 and, more preferably, from 470 to 900.

Among such surfactants represented by the formula (I), compounds represented by the following formula (II) are mentioned as preferable surfactants:

$$(R_1—L_2)_kJ\text{-}SO_3M \qquad \text{formula (II),}$$

wherein $R_1$ has the same meaning as $R_1$ in the formula (I); $L_2$ represents a divalent group selected from —O—, —CO— and —O—CO— (being bonded to $R_1$ at a left side of the group); k represents 2 or 3; J represents a linking group of (k+1) valence. However, J does not contain an aryl group; M represents a hydrogen atom or a metal atom. However, a sum of carbon atoms of $R_1$ in a portion represented by $(R_1—L_2)_k$ is 17 or more; and a molecular weight of a compound represented by the formula (II) (assuming that M is an hydrogen atom) is 430 or more.

In the formula (II), $R_1$ is preferably a saturated or unsaturated straight chained or branched chained aliphatic group containing a straight chain portion having at least 9 carbon atoms as a partial structure and, more preferably, a saturated or unsaturated straight chained or branched chained aliphatic group containing a straight chain portion having at least 12 carbon atoms as a partial structure. Further, in these aliphatic groups, a part of hydrogen atoms may be substituted with a halogen atom.

Further, a sum of carbon atoms of $R_1$ is 17 or more, preferably 20 or more and, more preferably, 24 or more.

$L_2$ represents a divalent group selected from the group consisting of —O—, —CO—, —O—CO— (being bonded with $R_1$ at a left side of the group), preferably —O—, —O—CO— (being bonded to $R_1$ at a left side of the group) and, most preferably, —O—CO— (being bonded to $R_1$ at a left side of the group).

J represents a linking group which does not contain an aryl group and, preferably, an alkylene group having 10 or less carbon atoms, a divalent group constituted by the alkylene group having 10 or less carbon atoms and an oxygen atom (ether group) (the position of the oxygen atom may be in the middle or at a terminal end of the alkylene group), or the group (J-9) as described in the explanation of J in the formula (I) and, more preferably, an alkylene group having 8 or less carbon atoms, a divalent group constituted by the alkylene group having 8 or less carbon atoms and an oxygen atom (the position of the oxygen atom may be in the middle or at a terminal end of the alkylene group), or the group (J-9) and, most preferably, the groups (J-1), (J-2), (J-3), (J-4), (J-5) and (J-9) as described in the formula (I) in which j is 6 or less in the groups (J-5) and (J-9).

k represents 2 or 3 and, preferably, 2.

Among the surfactants represented by the formula (I), other preferable surfactants include those represented by the following formulas (III) and (IV):

(III)

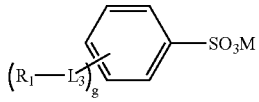

(IV)

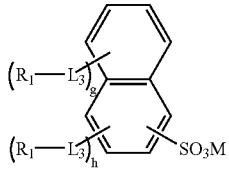

In the formulas (III) and (IV), $R_1$ has the same meaning as $R_1$ in the formula (I) and preferable examples are the same as those of $R_1$ in the formula (I).

$L_3$ represents a divalent group selected from among $—CHR_2$, —O—, —CO—, —COO—, (bonding may be in either direction), —OCOO—, $CONR_2$— (bonding may be in either direction), $—NR_2CONR_3—$, $—SO_2—$, $—SO_2NR_2—$ (bonding may be in either direction), —S—. $R_2$ and $R_3$ have the same meanings as those of $R_2$ and $R_3$ in the formula (I), respectively.

g represents a natural number of from 1 to 4; and h represents a natural number of from 1 to 3.

Compounds represented by the formulas (III) and (IV) will be described in detail.

$L_3$ is, preferably, $—CHR_2$, —O—, —CO—, —COO—, $CONR_2$— (bonding may be in either direction) or $—SO_2NR_2—$ (bonding may be in either direction) and, more preferably, $—CHR_2—$, —O—, —COO— (bonding may be in either direction) or $—CONR_2—$ (bonding may be in either direction).

g and h each represent 1 or 2 and it is preferable that g is 2, or g and h each represent 1.

According to the invention, in the formula (II) compounds that $R_1$ represents an aliphatic group having 10 to 20 carbon atoms in total including 9 or more carbon atoms in the straight chain portion; $L_2$ represents —O— or —OOC— (the oxygen atom being bonded to $R_1$); J represents a divalent group constituted by an alkylene group having 2 to 10 carbon atoms or an alkylene group having 2 to 10 carbon atoms and an oxygen atom; and k represents 2 or 3 are particularly preferable.

Specific examples of compounds represented by the formula (I) are described below but the invention is not limited thereto.
K-1
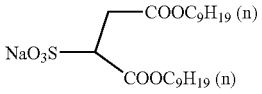
K-2
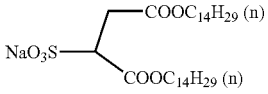
K-3
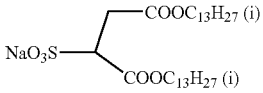
K-4
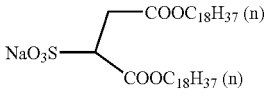
K-5
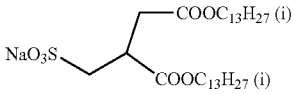
; i represents a mixture of branched alkyl groups
K-6
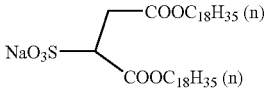
K-7
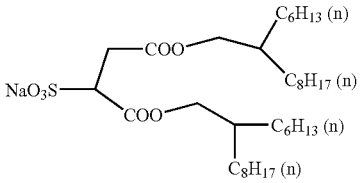
K-8
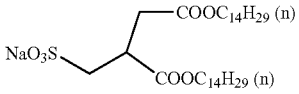
K-9
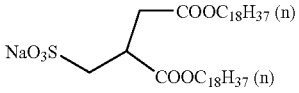
K-10
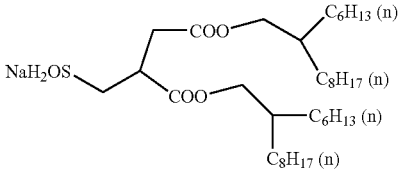
K-11
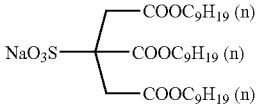
-continued
K-12
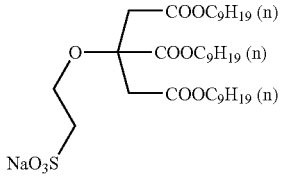
K-13
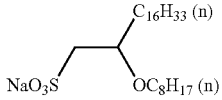
K-14
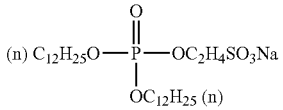
K-15
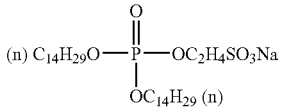
K-16
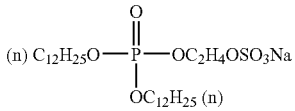
K-17
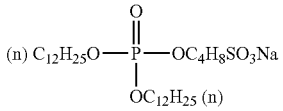
K-18
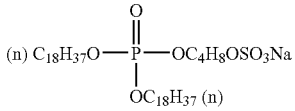
K-19
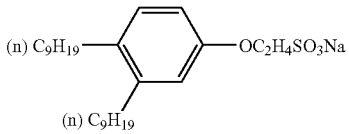
K-20
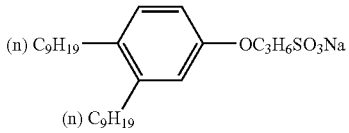
K-21
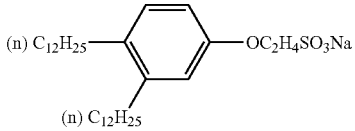
K-22
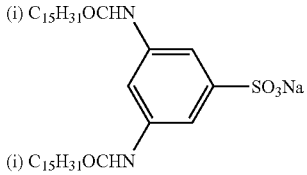

-continued

K-23

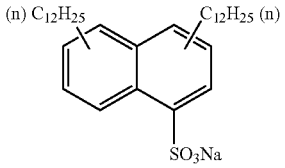

K-24

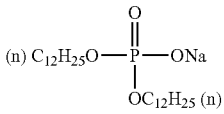

K-25

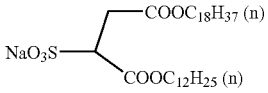

K-26

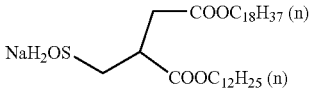

K-27

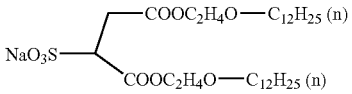

K-28

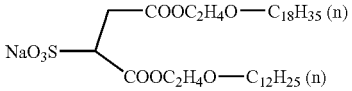

K-29

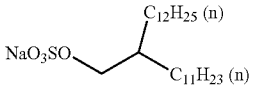

K-30

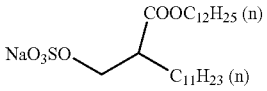

K-31

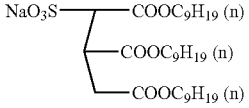

K-32

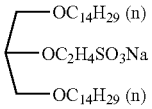

K-33

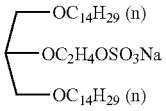

K-34

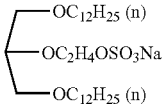

K-35

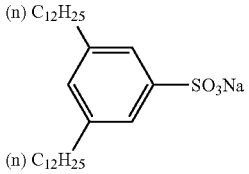

-continued

K-36

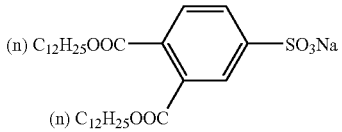

K-37

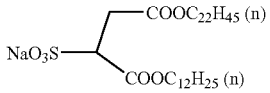

K-38

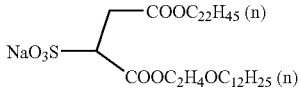

A method for adding the surfactant represented by the formula (I) into the photosensitive material may be any method and, preferably, oil-soluble compounds which are photographically useful such as a coupler, a color mixing prevention agent, an ultraviolet ray absorbing agent and the like are dissolved and, the surfactant is added at the time the thus-dissolved oil-soluble compounds are emulsified in an aqueous gelatin solution.

An amount of the surfactant represented by the formula (I) to be added is, preferably, in the range of from 0.01 g/$m^2$ to 1.0 g/$m^2$ and, more preferably, in the range of from 0.05 g to 0.5 g per one square meter of a photosensitive material. Further, when the surfactant according to the invention is used in an emulsifying step, the amount of the surfactant to be added is preferably in the range of from 1% by mass to 30% by mass and, more preferably, in the range of from 1% by mass to 20% by mass, based on the total amount of all the oil-soluble compounds contained in the emulsified dispersion.

The surfactant represented by the formula (I) may be used in combination with other surfactants. Examples of the other surfactants which are preferably used in combination are as follows; but, the surfactants which can be used in combination with the surfactant represented by the formula (I) are not limited thereto:

(W-1)

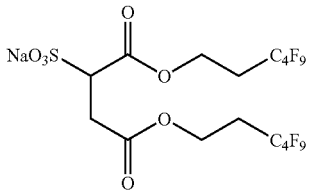

(W-2)

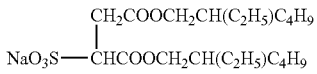

(W-3)

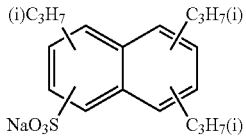

(W-4)

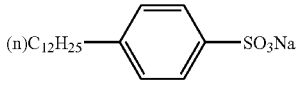

-continued (W-5)

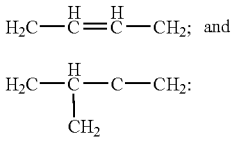

(a mixture of 60:40)

(W-6)

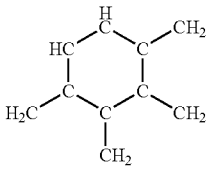

When the surfactant represented by the formula (I) and any one of the other surfactants are used in combination, an amount of the surfactant according to the invention to be used is preferably at least 20% by mass and, more preferably, at least 40% by mass, based on the total amount of all the surfactants contained in the photosensitive material.

The silver halide photographic photosensitive material according to the invention is characterized by containing the surfactant represented by the formula (I) and is typically a silver halide color photographic photosensitive material comprising at least one blue-sensitive emulsion layer containing a yellow color dye-forming coupler, at least one green-sensitive emulsion layer containing a magenta color dye-forming coupler and at least one red-sensitive emulsion layer containing a cyan color dye-forming coupler.

Particularly, the effect according to the invention is important in the silver halide photographic photosensitive materials for photographic use such as a color negative film and a color reversal film and the present invention is preferably applied to these color films.

Particularly, the present invention is preferably applied to the color reversal film, the image of which is directly viewed.

Examples of the image forming couplers according to the invention include the following couplers:

Yellow dye-forming couplers: couplers represented by the formulas (I) and (II) in EP-A No. 502,424; couplers represented by the formulas (1) and (2) in EP-A No. 513,496 (for example, Y-28 on page 18); a coupler represented by the formula (1) in claim 1 of EP-A No. 568,037; a coupler represented by the general formula (I) in column 1, lines 45 to 55, in U.S. Pat. No. 5,066,576; a coupler represented by the general formula (I) in paragraph 0008 of JP-A No. 4-274425; couplers described in claim 1 on page 40 in EP-A No. 498,381 (for example, D-35); couplers represented by the formula (Y) on page 4 in EP-A No. 447,969 (for example, Y-1 and Y-54); couplers represented by the formulas (II) to (IV) in column 7, lines 36 to 58, in U.S. Pat. No. 4,476,219; a coupler represented by the general formula (I) in JP-A No. 2002-318442; couplers represented by the general formulas (I) to (IV) in JP-A No. 2003-50449; and a coupler represented by the formula (I) in EP-A2 No. 1,246,006

Magenta dye-forming couplers: couplers described in JP-A No. 3-39737 (for example, L-57, L-68 and L-77); couplers described in EP-A No. 456,257 (for example, A-4-63, A4-73 and A-4-75); couplers described in EP-A No. 486,965 (for example, M-4, M-6 and M-7); couplers described in EP-A No. 571,959 (for example, M-45); couplers described in JP-A No. 5-204106 (for example, M-1); couplers described in JP-A No. 4-362631 (for example. M-22); couplers represented by the general formula (MC-1) in JP-A No. 11-119393 (for example, CA4, CA-7, CA-12, CA-15, CA-16 and CA-18); couplers represented by the general formulas (M-I) and (M-II) in U.S. Pat. No. 6,492,100; and couplers represented by the formula (I) in U.S. Pat. No. 6,468,729.

Cyan dye-forming couplers: couplers described in JP-A No. 4-204843 (for example., CX-1, 3, 4, 5, 11, 12, 14 and 15); couplers described in JP-A No. 443345 (for example, C-7, 10, 34, 35, (I-1) and (I-17)); couplers represented by the general formulas (Ia) and (Ib) in claim 1 of JP-A No. 6-67385; couplers represented by the general formula (PC-1) in JP-A No. 11-119393 (for example, CB-1, CB4, CB-5, CB-9, CB-34, CB-44, CB-49 and CB-51); couplers represented by the general formula (NC-1) in JP-A No. 11-119393 (for example, CC-1 and CC-17); and a coupler represented by the general formula (I) in JP-A No. 2002-162717.

When the photographically useful oil-soluble compounds are emulsified by using the surfactant represented by the formula (I), a high-boiling point solvent may be used. Examples of such high-boiling point solvents to be employed include phthalic acid esters (for example, dibutyl phthalate, dioctyl phthalate, dicyclohexyl phthalate, di-2-ethylhexyl phthalate, decyl phthalate, bis(2,4-di-tert-amylphenyl)isophthalate and bis(1,1-diethylpropyl)phthalate), esters of phosphoric acid or phosphonic acid (for example, diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridecyl phosphate and di-2-ethylhexyl phenyl phosphate), benzoic acid esters (for example, 2-ethylhexyl benzoate, 2,4-dichlorobenzoate, dodecyl benzoate and 2-ethylhexyl-p-hydroxybenzoate), amides (for example, N,N-diethyl dodecanamide, N,N-diethyl laurylamide, N,N,N,N-tetrakis(2-ethylhexyl)isophthalamide, N,N,N,N-tetrakiscyclohexyl isophthalamide and ortho-hexadecyloxybenzamide), compounds as described in JP-A Nos. 2000-29159, 2001-281821, 2002-40606 and 8-110624, alcohols (for example, isostearyl alcohol and oleyl alcohol), aliphatic esters (for example, dibutoxyethyl succinate, di-2-ethylhexyl succinate, 2-hexyldecyl tetradecanoate, tributyl citrate, diethyl azelate, isostearyl lactate and trioctyl citrate), aniline derivatives (for example, N,N-dibutyl-2butoxy-5-tert-octylaniline), chlorinated paraffins (paraffins each having a chlorine content of from 10% to 80%), trimesic acid esters (for example, tributyl trimesate), dodecyl benzene, diisopropyl naphthalene, phenols (for example, 2,4-di-tert-amyl phenol, 4-dodecyloxyphenol, 4-dodecyloxycarbonyl phenol and 4-(4-dodecyloxyphenylsulfonyl)phenol), carboxylic acids (for example, 2-(2,4-di-tert-amylphenoxy)butyric acid and 2-ethoxyoctanedecanoic acid) and alkyl phosphoric acids (for example, di-2-ethylhexyl phosphoric acid and diphenyl phosphoric acid).

In addition to these high-boiling point solvents, compounds described in JP-A No. 6-258803 are preferably used as high-boiling point solvents.

With respect to a latex dispersing method as one of polymer dispersing methods, the steps and effects of the method, and examples of impregnation latexes are described in, for example, U.S. Pat. No. 4,199,363, OLS Nos. 2,541,274 and 2,541,230, JP-B No. 53-41091 and EP-A No. 029104. Further, dispersion by an organic solvent-soluble polymer is described in WO 88/00723.

Further, as an auxiliary solvent, an organic solvent having a boiling point of 30° C. to about 160° C. (for example, ethyl acetate, butyl acetate, ethyl propionate, methyl ethyl ketone, cyclohexanone, 2-ethoxyethyl acetate, dimethyl formamide, methanol or ethanol) may be used in combination.

Next, a photosensitive emulsion layer which does not substantially form a color during development processing (hereinafter, referred to also as "non-color-forming photosensitive emulsion layer" for short) according to the invention will be described.

The term "substantially non-color-forming" in the non-color-forming photosensitive emulsion layer according to the invention as used herein means that the contribution of the non-color-forming layer to yellow, magenta and cyan dye image densities in a photograph is negligible. The non-color-forming photosensitive emulsion layer may contain a small amount of a coupler, such that the amount of a color forming coupler in the non-color-forming photosensitive emulsion layer may be 10% or less, based on the total amount of the couplers, contained in the entire photographic element, which form color in the same color range as the non-color-forming photosensitive emulsion layer. The non-color-forming photosensitive emulsion layer is preferably a low color forming layer in which the color forming coupler is 5% or less (more preferably 2% or less) relative to the couplers which form color in a same color range in the photosensitive element, or a layer which does not contain any dye image forming coupler. The non-color-forming photosensitive emulsion layer of the present invention preferably contain a color mixing prevention agent.

The non-color-forming photosensitive layer according to the invention may be placed in any position in the photosensitive material and, also, the non-color-forming photosensitive emulsion layer may have a spectral sensitivity in any wavelength range. A photosensitive emulsion used in the non-color-forming photosensitive emulsion layer of the present invention has a spectral sensitivity in a visible light range and the non-color-forming photosensitive emulsion layer preferably contains a blue sensitive emulsion, a green sensitive emulsion or a red sensitive emulsion. It is also preferable to impart a cyan light sensitivity to the non-color-forming emulsion layer.

In the non-color-forming photosensitive emulsion layer according to the invention, the blue-sensitivity means that the emulsion layer has a sensitivity at a wavelength in the range of from 430 nm to 480 nm where the spectral sensitivity of the emulsion layer has a maximum value of spectral sensitivity. Similarly, the green-sensitivity means that the maximum sensitivity is in the range of from 520 nm to 570 nm and the red-sensitivity means that the maximum sensitivity is in the range of from 600 nm to 670 nm. Further, cyan light-sensitivity of the layer means that the maximum sensitivity is in the range of from 490 nm to 540 nm.

Further, specifically, one preferred embodiment of the invention includes that: in a photosensitive element comprising a support and, on the support, an antihalation layer/a first intermediate layer/a red-sensitive emulsion layer unit (preferably, including three layers, namely, a low-speed red-sensitive layer/a medium-speed red-sensitive layer/a high-speed red-sensitive layer arranged in this order from the support side)/a second intermediate layer/a green-sensitive emulsion layer unit (preferably, including three layers, namely, a low-speed green-sensitive layer/a medium-speed green-sensitive layer/a high-speed green-sensitive layer arranged in this order from the support side)/a third intermediate layer/a yellow-filter layer/a blue-sensitive emulsion layer unit (preferably, including three layers, namely, a low-speed blue-sensitive layer/a medium-speed blue-sensitive layer/a high-speed blue-sensitive layer arranged in this order from the support side)/a first protective layer/a second protective layer, are coated in this order, wherein the non-color-forming photosensitive emulsion layer of the invention is provided by coating any one of positions between the antihalation layer and the first intermediate layer, the high-speed red-sensitive emulsion layer and the second intermediate layer, the second intermediate layer and the low-speed green-sensitive emulsion layer, the yellow-filter layer and the low-speed blue-sensitive emulsion layer, the first protective layer and the high-speed blue-sensitive emulsion layer, or the first protective layer and the second protective layer, or a plural positions selected from the above positions.

The first, second and third intermediate layers may each be constituted by a single layer or two or more layers. Couplers, DIR compounds and the like as described in JP-A Nos. 61-43748, 59-113438, 59-113440, 61-20037 and 61-20038 may be contained therein and, further, a color mixing prevention agent may also be contained therein as is customarily employed.

It is also preferable that the protective layer has a three-layer constitution of a first to third protective layers. When the protective layer is in a two-layer or three-layer constitution, silver halide fine grains having an average equivalent-sphere diameter of 0.10 μm or less are preferably contained in the second protective layer. The silver halide is preferably silver bromide or silver iodobromide.

An amount of the photosensitive silver halide to be contained in the non-color-forming photosensitive emulsion layer according to the invention is, in terms of an amount of silver per $m^2$ of the photosensitive material, preferably in the range of from 0.01 g to 2.0 g and, more preferably, in the range of from 0.01 g to 1.0 g and, particularly preferably, in the range of from 0.05 g to 0.5 g. Further, an amount of gelatin to be applied is, per $m^2$ of the photosensitive material, preferably in the range of from 0.1 g to 2.0 g and, more preferably, in the range of from 0.1 g to 1.0 g.

Next, the photosensitive silver halide grains according to the invention will be described. The grains to be described below can be used in either the color forming photosensitive emulsion layer or the non-color-forming photosensitive emulsion layer of the present invention.

The silver halide grains to be used in the invention may contain any type of silver halides and, preferably, contain silver iodobromide or silver iodochlorobromide and, more preferably, silver iodobromide or silver iodochlorobromide containing silver iodide in an amount of from 0.5% by mole to 20% by mole. When the silver halide is used in the non-color-forming photosensitive emulsion layer, the preferable silver halide grains are silver iodobromide containing from 3% by mole to 20% by mole (more preferably, from 7% by mole to 20% by mole) of silver iodide.

It is preferable that the silver halide grains of the present invention have a variation coefficient of the silver iodide content distribution among grains of 20% or less. It is more preferably 15% or less, and particularly preferably 10% or less. When the above variation coefficient is larger than 20%, it is not preferable because a high contrast is not obtained and the sensitivity when pressure is applied to the photosensitive layer is greatly reduced. The silver iodide content of each grain can be measured by analyzing compositions of grains each individually using an X-ray micro analyzer. The variation coefficient of the silver iodide content distribution among grains is a value defined by the relational expression, (standard deviation/average silver iodide content)×100=variation coefficient, using the standard deviation of silver iodide content and average silver iodide content when the silver iodide content of emulsion grains of at least 100, more preferably 200 or more, and particularly preferably 300 or more was measured. The measurement of the silver iodide content of each individual grain is described in, for example, European Patent No. 147,868. There are a case where correlation exists between the silver iodide content Yi (% by mole) of each individual grains and the equivalent-sphere diameter Xi (μm), and a case where no correlation exists therebetween, but it is desirable that there is no correlation As for a halogen composition inside a grain of the silver halide emulsion to be used in the present invention, the silver halide emulsion may have a multi-structure, for example, a five-fold structure. Here, the structure means that the distribution of silver iodide has a structure and that the difference in silver iodide content between the structures is of 1% by mole or more. The structures concerning the distribution of silver iodide can be basically determined by calculation from the formulation value of preparation process of grains. There can be a case where the variation of the silver iodide content change sharply and a case where in the variation of the silver iodide content changes mildly at the interface between the respective structures. It is required to consider the accuracy of measurement of analysis in order to confirm these variations, but an EPMA method (Electron Probe Micro Analyzer method) is usually effective. An elemental analysis of an ultra-fine region which is irradiated with an electron beam can be carried out by preparing a sample in which emulsion grains are dispersed so as not to be in contact with one another and by analyzing X-ray emitted when the grain is irradiated with the electron beam. It is preferable to carry out the measurement at this time by cooling at a low temperature in order to prevent a damage of the sample caused by the electron beam. The distribution of silver iodide in grains when the tabular grains are viewed in a direction perpendicular to the principal surfaces thereof can be analyzed by the procedure, but the distribution of silver iodide in grains at sections of the tabular grains can be also analyzed by solidifying the same sample and using samples slice into ultra thin fragments by a microtome.

In the present invention, any shape of silver halide grains may be used and, as the shape thereof to be preferably contained, tabular silver halide grains are exemplified. The tabular silver halide grains generally refer to silver halide grains each having one twin plane or two or more parallel twin planes. The twin plane refers to a (111) face on both sides of which the ions of all lattice points are in the relationship of mirror images. These tabular grains are each composed of two main surfaces which are parallel to each other and side surfaces joining the main surfaces to each other. The main surfaces of tabular grains, as viewed from above, have triangular or hexagonal shapes, or circular shapes corresponding to rounding thereof. The triangular, hexagonal and circular tabular grains respectively have triangular, hexagonal and circular main surfaces arranged parallel to each other.

An aspect ratio of tabular grains refers to the quotient of grain diameter divided by grain thickness. The grain thickness can be easily determined by performing a vapor deposition of metal on grains, together with reference latex, in an oblique direction thereof, measuring the length of grain shadow on an electron micrograph and calculating with reference to the length of latex shadow. The grain diameter refers to a diameter of a circle having the same area as the projected area of mutually parallel main surfaces of grain. The projected area of grains can be obtained by measuring the grain area on an electron micrograph and performing correction of photographing magnification.

In order to obtain monodisperse tabular grains having a large aspect ratio gelatin may be additionally during grain formation. The gelatin to be used in this case is preferably chemically-modified gelatin as described in JP-A Nos. 10-148897 and 11-143002 or gelatin containing a small amount of methionine as described in U.S. Pat. Nos. 4,713,320 and 4,942,120. In particular, the former chemically-modified gelatin is gelatin characterized by newly introducing at least 2 carboxyl groups when amino groups in the gelatin are chemically modified, and succinic gelatin or trimellitic gelatin is preferably used. It is preferable to add the chemically-modified gelatin before a crystal growth step and is more preferable to add it immediately after nucleation. An amount of the chemically-modified gelatin to be added is preferably 50% or more, more preferably 70% or more, based on the mass of the total dispersing medium during grain formation.

As for silver halide solvents which can be used in the present invention, (a) organic thioethers as described in U.S. Pat. Nos. 3,271,157, 3,531,286 and 3,574,628, JP-A Nos. 54-1019 and 54-158917 and the like; (b) thiourea derivatives as described in JP-A Nos. 53-82408, 55-77737 and 55-2982, and the like; (c) silver halide solvents each having a thiocarbonyl group interposed between an oxygen or a sulfur atom and a nitrogen atom as described in JP-A No. 53-144319; (d) imidazoles as described in JP-A No. 54-100717; (e) sulfites; (f) ammonia; (g) thiocyanates; and the like are mentioned. Particularly preferred silver halide solvents are thiocyanates, ammonia, tetramethyl thiourea and the like. Further, an amount of such silver halide solvent to be used varies depending on the type thereof; for example, in the case of thiocyanate, a preferred amount thereof to be used is from $1\times10_{-4}$ mole to $1\times10_{-2}$ mole per mole of the silver halide. Even when any one of the solvents is used, the solvent can fundamentally be removed by providing a washing step after formation of a first shell as previously described.

As one preferred embodiment of the tabular grains according to the invention, the tabular grains having dislocations can be mentioned.

First, the tabular grains having dislocations will be described.

Dislocation in the tabular grains can be observed by a direct method using a transmission electron microscope at a low temperature, as described in, for example, J. F. Hamilton, Phot. Sci. Eng., 11, 57, (1967) or T. Shiozawa, J. Soc. Phot. Sci. Japan, 35, 213, (1972). That is, silver halide grains carefully taken out of an emulsion such that pressure is not applied to the grains to an extent that dislocations in the grains are formed, are placed on a mesh for electron microscopic observation. Observation is performed by a transmission method while the sample is cooled to prevent damage (for example, print out) due to an electron beam. In this observation, as the thickness of a grain is increased, it becomes more difficult to transmit electron beam through the grain. Therefore, grains can be observed more clearly by using an electron microscope of a high voltage type (200 kV or more for a grain having a thickness of 0.25 μm). From photographs of grains obtained by the above-described method, it is possible to obtain the positions of dislocations in each grain viewed in a direction perpendicular to the principal planes of the grain.

The dislocations of the tabular grain are allowed to form in a zone extending to each edge side from a distance of x % of the length from the center of the grain to the edge thereof in the direction of the long axis of the tabular grains. The value of x is preferably $10 \leqq x < 100$, more preferably $30 \leqq x < 98$ and, still more preferably $50 \leqq x < 95$. The configuration formed by connecting positions at which the dislocations start is approximately similar to the grain shape but is not the completely similar shape and may be slightly deformed. The direction of dislocation lines approximately is in the direction from the center of the grain to the edge thereof but is often serpentined.

The number of dislocations in the tabular grains, preferably, the number of grains each having 10 or more dislocation lines is 50% or more (in terms of numbers) of the total grains. More preferably, the number of grains having 10 or more dislocation lines is 80% or more (in terms of numbers) of the total grains. Particularly preferably, the number of grains having 20 or more dislocation lines is 80% or more (in terms of numbers) of the total grains.

When the silver halide grains to be used in the present invention are tabular grains each having the dislocation, the aspect ratio of such silver halide grain is 2 or more, preferably 3 or more and, more preferably, in the range of from 4 to 20.

The dislocation of the tabular grain used in the present invention is introduced by providing a high-iodide content phase to the inside of the grain. The high-iodide content phase denotes a silver halide solid solution containing iodine and, in this case, as the silver halide, silver iodide, silver iodobromide and silver chloroiodobromide are preferable, silver iodide or silver iodobromide is more preferable, and silver iodide is particularly preferable in. An amount of the silver halide which forms the high-iodide content phase is, in terms of the amount of silver, preferably 30% by mole or less and, more preferably, 10% by mole or less of the amount of silver in the total grains.

A phase to be grown at an outer side of the high-iodide content phase is required to have an iodide content lower than that in the high-iodide content phase, and a preferable iodide content thereof is from 0% by mole to 12% by mole, more preferably from 0% by mole to 6% by mole and, most preferably, from 0% by mole to 3% by mole.

Preferable methods of forming the high-iodide content phase includes method in which an emulsion containing silver iodobromide or silver iodide fine grains is added to form the high-iodide content phase. These fine grains which have previously been prepared can be used and, preferably, the fine grains immediately after preparation of the grains can be used.

A case in which the fine grains which have previously been prepared is firstly described. In this case, there is a method in which the fine grains which have previously been prepared are added, followed by ripening and dissolving the grains. As for a more preferable method, there is a method in which the silver iodide fine grain emulsion is added and, subsequently, an aqueous silver nitrate solution, or both the aqueous silver nitrate solution and an aqueous halide solution are added. In this case, dissolution of the silver iodide fine grain emulsion is accelerated by an addition of the aqueous silver nitrate solution. It is preferred that the silver iodide fine grain emulsion is rapidly added.

Such rapid addition of the silver iodide fine grain emulsion means that the silver iodide fine grain emulsion is added within preferably 10 minutes, preferably within 7 minutes. The adding conditions may vary in accordance with the temperature, pBr and pH of a system to be added, the kind and concentration of protective colloid agents such as a gelatin and the like, the presence or absence, kind, and concentration of the silver halide solvent, and the like, but the shorter period is preferable as described above. It is preferable that the addition of an aqueous silver salt solution such as silver nitrate or the like is not substantially carried out at the addition. The temperature of the system at the addition is preferably from 40° C. to 90° C. and, particularly preferably, from 50° C. to 80° C.

The silver iodide fine grain emulsion may be substantially silver iodide and at least one of silver bromide and silver chloride may be contained so far as it can form a mix crystal, which will be described in detail below.

Another preferred embodiment of the tabular grain to be used in the present invention is a tabular silver halide host grain having two main planes which are parallel to each other in an aspect ratio of 2 or more (hereinafter, referred to also as "host tabular grain" or "host grain" for short), or a tabular silver halide grain comprising a protrusion portion of the silver halide (hereinafter, referred to also as "silver halide protrusion portion" or "protrusion portion" for short) epitaxially joined onto a surface of the host grain (hereinafter, referred to also as "epitaxial junction tabular grain"). The term "protrusion portion" as used herein means a portion protruded relative to the host grain and the portion can be visually identified by using an electron microscope.

The host tabular grain comprises two main planes which are parallel to each other and side faces joining these two main planes. A shape of each of the main planes may be any one of an arbitrary polygon, a circle, an ellipsoid or the like encompassed by a straight line, a shape contoured by an undefined curve and a shape contoured by a combination of a straight line and a curve and, preferably the shape has at least one apex. Further, more preferably, it is any one of a triangle having three apexes, a quadrangle having four apexes, a pentagon having five apexes, a hexagon having six apexes, or combinations thereof. The term "apex" as used herein is intended to indicate an angle which is formed by two adjacent sides and is not round. When the angle is roundish, a point at which a length of a curved portion is bisected is defined as an apex.

Any type of crystal structures of the main plane of the host tabular grain in the epitaxial junction tabular grain can be used. That is, the crystal structure of the main plane may be any one of a (111) plane, a (100) and a (110) plane, or a high-order plane, and a most preferred embodiment is a tabular grain in which the main plane is a (111) plane or a (100) plane. In the case of the tabular grain in which the main plane is the (111), a embodiment in which the grains each having the main plane in a shape of hexagon having six apexes is 70% or more of the entire projected area of grains is preferred. Further, in the case of the tabular grain in which the main plane is the (100), a embodiment in which the grains each having the main plane in a shape of a quadrangle having four apexes is 70% or more of the entire projected area of grains is preferred.

The host tabular grain in the epitaxial junction tabular grain has an aspect ratio of 2 or more, the aspect ratio being obtained by dividing an equivalent-circle diameter of grain by thickness of the grain. The aspect ratio is preferably in the range of from 5 to 200, more preferably in the range of from 10 to 200 and, most preferably, in the range of from 15 to 200. The equivalent-circle diameter of a grain refers to the diameter of a circle having the same area as the projected area of the main plane of the grain.

The equivalent-circle diameter of the host tabular grain can be obtained by first taking a transmission electron microscopic photograph by using a replica method and, next, obtaining a projected area of each grain by performing magnification correction thereto and, then, converting the thus-obtained projected area into an equivalent-circle diameter. Although there is a case in which thickness of grain can not be calculated from length of a shadow of a replica in a simple manner due to epitaxial deposition, the thickness thereof can be calculated by measuring the length of the shadow of the replica prior to the epitaxial deposition. Otherwise, even after the epitaxial deposition, the thickness thereof can easily be obtained by cutting a sample coated with an emulsion, and, taking the electron microscopic photograph of a cross-section of the cut sample.

The equivalent-circle diameter of the host tabular grain in the epitaxial junction tabular grain is preferably in the range of from 0.5 μm to 10.0 μm and, more preferably, in the range of from 0.7 μm to 10.0 μm. Further, the thickness of grain is, preferably, in the range of from 0.02 μm to 0.5 μm, more preferably in the range of from 0.02 μm to 0.2 μm and, most preferably, in the range of from 0.03 μm to 0.15 μm.

In the host tabular grain in the epitaxial junction tabular grain, a variation coefficient of the equivalent-circle diameter among grains is, preferably, 40% or less, more preferably 30% or less and, particularly preferably, 25% or less. The term "variation coefficient of the equivalent-circle diameter among grains" as used herein means a value as defined by dividing the standard deviation of distribution of equivalent-circle diameters of grains by an average equivalent-circle diameter, and by multiplying the obtained quotient by 100.

In the epitaxial junction tabular grain, the silver halide protrusion portion is formed in an arbitrary position on a surface of the host tabular grain by the epitaxial junction. Such forming position is, preferably, on a major plane, on an apex portion or on a side except for the apex portion of the host tabular grain and, most preferably, on the apex portion thereof. The term "apex portion" as used herein is intended to indicate a portion within a circle having a diameter of one third of a length of a shorter side between two sides adjacent to an apex, when the tabular plane is viewed in a direction perpendicular to the main plane. Specifically, an embodiment in which silver halide grains in each of which the protruded portion is present in all of the apexes on the main plane of the host tabular grain are 70% or more of the entire projected area is preferable, an embodiment in which such silver halide grains are 80% or more thereof is more preferable and an embodiment in which such silver halide grains are 90% or more thereof is still more preferable.

An amount of silver in the silver halide protrusion portion in the epitaxial junction tabular grain is characterized by a ratio of 12% or less relative to the amount of silver of the host tabular grain. The ratio of the amount of silver is, more preferably, in the range of from 0.5% to 10% and, still more preferably, in the range of from 1% to 8%. When the amount of silver is too small, a reproduction property of repeating an epitaxial formation is deteriorated, while, when the amount of silver is too large, a problem is caused such that sensitivity is reduced or graininess is deteriorated. Further, a ratio of the silver halide protrusion portion present on the surface of the grain is preferably 50% or less and, more preferably, 20% or less.

The silver halide protrusion portion of the epitaxial tabular grain preferably contains a pseudo halide. The term "pseudo halide" as used herein refers, as described in JP-A No. 7-72569, to a group of compounds know as having similar properties as those of a halide (namely, capable of providing sufficiently electrically negative monovalent anion groups at least exhibiting the same positive Hammett sigma value as that of the halide, such as $CN^-$, $OCN^-$, $SCN^-$, $SeCN^-$, $TeCN^-$, $N_3^-$, $C(CN)_3^-$ and $CH^-$). The pseudo halide content of the protrusion portion is preferably 0.01 to 10% by mole relative to the silver amount of the protrusion portion, and more preferably, 0.1 to 7% by mole.

In the epitaxial tabular grain, the halogen composition of each of the host grain and the protrusion portion is pure silver bromide, or silver iodobromide, silver chlorobromide, or silver chloroiodobromide having a silver bromide content of 70% by mole or more. When the content is less than 70% by mole, an increase in fog after storage becomes large, which is problematic. The silver bromide content is preferably 80% by mole, and more preferably, 90% by mole or more.

In the epitaxial tabular grain, the average silver iodide content of all the grains is preferably 20% by mole or less, more preferably 15% by mole or less and, most preferably, 10% by mole or less. When the silver iodide content exceeds 20% by mole, a sufficiently high sensitivity cannot be obtained. An embodiment in which the average silver iodide content of the protrusion portion is lower than that of an outer-shell-8%-region (relative to the silver amount of the host grain) of the host grain is preferred. The term "outer-shell8%-region of the host grain" as used herein means a layered region spread from the surface toward the center of the host grain in which the silver amount is 8% with respect to the total silver amount of the host grain.

In the epitaxial tabular grain, the silver chloride content of each of the host grain and the protrusion portion is preferably 8% by mole or less, more preferably 4% by mole or less, and most preferably, 1% by mole or less.

In the epitaxial tabular grain, the distribution of the silver iodide content among grains is preferably monodisperse. More specifically, an embodiment in which 70% or more of the total projected area of the grains is occupied by the silver halide grains having a silver iodide content within the range of 0.6I to 1.4I, when the average silver iodide content of all the grains is I mole %, is preferable. An embodiment in which 70% or more of the total projected area of the grains is occupied by the silver halide grains having a silver iodide content within the range of 0.7I to 1.3I is more preferable.

In the epitaxial tabular grain, the host grain or protrusion portion, or both the host grain and protrusion portion may contain, as a part of silver halide, a silver salt other than silver chloride, silver bromide, or silver iodide, such as silver rhodanide, silver selenocyanate, silver tellurocyanate, silver sulfide, silver selenide, silver telluride, silver carbonate, silver phosphate, organic silver salt and the like. Otherwise, a silver salt other than the silver halides may be contained in separate grains in the emulsion of the present invention.

Further, the host grain used in the present invention may have a multiple structure of a double structure or more with respect to the intra-grain halide composition distribution. The host grain may have a quintuple structure, for example. The structure used herein refers to a structure with respect to the intra-grain silver iodide distribution and means that the difference in silver iodide content among respective structures is of 1% by mole or more. This intra-grain silver iodide distribution structure can be basically obtained by calculations from the formulation value in the grain preparation step. The silver iodide content at the interface between layers in the structure, can change either abruptly or moderately. The EPMA (Electron Probe Micro Analyzer) method is usually effective to confirm this structure, although the measurement accuracy of analysis must be taken into consideration. A sample in which emulsion grains are dispersed so as not to be in contact with each other is prepared, and X-rays emitted from the sample is analyzed when the sample is irradiated with an electron beam, so that an elemental analysis in a micro region irradiated with the electron beam can be performed. The measurement is preferably performed under cooling at low temperatures in order to prevent damage to the sample due to the electron beam irradiation. By this method, the intra-grain silver iodide distribution of a tabular grain can be analyzed when the grain is viewed in a direction perpendicular to the main planes. Additionally, when a specimen obtained by hardening a sample and cutting the sample into a very thin piece using microtome is used, the intra-grain silver iodide distribution in the resultant cross-section of a tabular grain can be analyzed.

In the silver halide emulsion to be used in the present invention, an embodiment in which silver halide grains in which a dislocation line is not present in other portions than the epitaxial junction portions are 70% or more of the entire projected area is preferred. Further, an embodiment in which silver halide grains which do not have a dislocation line in any region of the grain including the epitaxial junction portion is 70% or more of the entire projected area is more preferred.

Next, a method of producing tabular grains each having a (111) plane as a main plane (hereinafter, referred to as "(111) tabular grain"), which is one of preferred embodiments of the host tabular grains of the present invention, will be described below. The (111) tabular grain to be used in the present invention can be prepared by improving the methods described in Cleve, "Photography Theory and Practice (1930)", p. 13; Gutoff, "Photographic Science and Engineering", Vol. 14, pp. 248 to 257 (1970); and U.S. Pat. Nos. 4,434,226, 4,414,310, 4,433,048, 4,439,520, and GB No. 2,112,157; and the like.

The preparation of the (111) tabular grain is basically performed by a combination of three steps of: nucleation; ripening; and growth. In the nucleation step, it is extremely effective to use gelatin having a low methionine content as described in U.S. Pat. Nos. 4,713,320 and 4,942,120, perform nucleation at a high pBr value as described in U.S. Pat. No. 4,914,014, and perform the nucleation within a short period of time as described in JP-A No. 2-222940. According to the invention, it is particularly preferable to perform stirring in the presence of low-molecular-weight oxidization-processed gelatin at a temperature of 20° C. to 40° C. and add an aqueous silver nitrate solution, aqueous halogen solution, and low-molecular-weight oxidization-processed gelatin within one minute. At this time, the pBr and pH of the system are preferably 2 or more and 7 or less, respectively. The concentration of the aqueous silver nitrate solution is, preferably, 0.6 mole/liter or less.

The ripening step of a tabular grain emulsion of the invention can be performed in the presence of a low concentration base as described in U.S. Pat. No. 5,254,453 or at a high pH as described in U.S. Pat. No. 5,013,641. Polyalkylene oxide compounds as described in U.S. Pat. Nos. 5,147,771, 5,147,772, 5,147,773, 5,171,659, 5,210,013 and 5,252,453 can be added in the ripening step or in the subsequent growth step. According to the invention, the ripening step is preferably performed at a temperature of 50° C. to 80° C. The pBr value is preferably lowered to 2 or less immediately after nucleation or during ripening. Further, supplementary gelatin is preferably added during a period of from the timing immediately after nucleation to the end of ripening. Particularly preferred gelatin is that 95% or more of amino groups is modified by succination or trimellitation.

The growth step is usually performed by a known method of simultaneously adding an aqueous silver nitrate solution and an aqueous halogen solution, but can also be performed by using a method of simultaneously adding a silver nitrate solution, an aqueous halide solution containing a bromide, and an emulsion containing silver iodide fine-grains (hereinafter referred to also as a "silver iodide fine-grain emulsion"), as described in U.S. Pat. Nos. 4,672,027 and 4,693,964.

The silver halide grain contained in the silver iodide fine-grain emulsion substantially need only be silver iodide and may contain at least one of silver bromide and silver chloride so long as a mixed crystal can be formed. The emulsion is preferably 100% silver iodide. The crystal structure of silver iodide can be a β body, a γ body, or, as described in U.S. Pat. No. 4,672,026, an α body or an α body-similar structure. According to the invention, the crystal structure is not particularly restricted but is preferably a mixture of β and γ bodies, and more preferably, a β body. The silver iodide fine-grain emulsion can be either an emulsion formed immediately before the addition thereof as described in, for example, U.S. Pat. No. 5,004,679 or an emulsion subjected to a regular washing step. In the present invention, an emulsion subjected to a regular washing step is preferably used. The silver iodide fine-grain emulsion can be readily formed by a method as described in, for example, U.S. Pat. No. 4,672,026. A double-jet addition method using an aqueous silver salt solution and an aqueous iodide salt solution in which grain formation is performed at a fixed pI value is preferred. The term "pI" as used herein refers to a logarithm of a reciprocal of the $I^-$ ion concentration of the system. The temperature, pI, and pH values of the system, the type and concentration of a protective colloid agent such as gelatin, and the presence or absence, type, and concentration of a silver halide solvent are not particularly limited. However, a grain size of preferably 0.1 μm or less, and more preferably, 0.07 μm or less is suitable for the present invention. Although the grain shape cannot be perfectly specified because the grain is a fine grain, the variation coefficient of a grain size distribution is preferably 25% or less. The present invention exerts remarkably its effect when the variation coefficient is 20% or less.

The size and the size distribution of the silver iodide fine-grain emulsion are obtained by placing the silver iodide fine grain on a mesh for electron microscopic observation and directly observing the grains by a transmission method instead of a carbon replica method. This is because measurement errors are increased when observation is carried out by the carbon replica method since the grain size is too small. The grain size is defined as the diameter of a circle having an area equal to the projected surface area of the observed grain. The grain size distribution also is obtained by using this equivalent-circle diameter of the projected surface area. In the present invention, the most effective silver iodide fine grains have a grain size of 0.02 μm to 0.06 μm and a grain size distribution variation coefficient of 18% or less.

After the grain formation is performed as described above, the silver iodide fine-grain emulsion is preferably subjected to regular washing as described in, for example, U.S. Pat. No. 2,614,929, and adjustments of the pH, the pI, the concentration of a protective colloid agent such as gelatin, and the concentration of the contained silver iodide are performed. The pH value is preferably 5 to 7. The pI value is preferably the value at which the solubility of silver iodide is a minimum or the value higher than that value. As the protective colloid agent, a common gelatin having an average molecular weight of approximately 100,000 is preferably used. A low molecular weight gelatin having an average molecular weight of 20,000 or less also is favorably used. It is sometimes suitable to use a mixture of various types of gelatin having different molecular weights. The gelatin amount is preferably 10 to 100 g, and more preferably, 20 to 80 g per kg of an emulsion. The silver amount is preferably 10 to 100 g and, more preferably, 20 to 80 g, in terms of the amount of silver atom, per kg of an emulsion. The silver iodide fine-grain emulsion is usually dissolved before being added. During such addition, it is necessary to sufficiently enhance the efficiency of stirring of the system. The rotational speed of stirring is preferably set to be higher than usual. An addition of an antifoaming agent is effective to prevent the formation of foam during the stirring. More specifically, an antifoaming agent as described in, for example, Examples of U.S. Pat. No. 5,275,929 is used.

In the growth step, an external stirring apparatus as described in JP-A No. 10-43570 can be used. That is, there is provided a method in which an emulsion containing fine grains of silver bromide, silver iodobromide, or silver iodochlorobromide (hereinafter, referred to also as an "ultrafine grain emulsion"), which is prepared in the stirring apparatus immediately before the addition thereof, is continuously added at the time of the growth of the tabular grain and allowed to be dissolved to grow the tabular grain. Such external mixer used for preparing the ultrafine grain emulsion has a high stirring power. An aqueous silver nitrate solution, aqueous halogen solution, and gelatin are added to the mixer. Gelatin can be mixed in at least one of the aqueous silver nitrate solution and the aqueous halogen solution beforehand or immediately before the addition. Alternatively, an aqueous gelatin solution can be added separately. The molecular weight of the gelatin is preferably lower than usual, and, particularly preferably, 10,000 to 50,000. It is particularly preferable to use at least one of gelatin in which 90% or more of an amino group is modified by phthalation, succination or trimellitation, and an oxidization-processed gelatin in which a methionine content is lowered.

Next, a process of preparing the tabular grain having a (100) plane as a main plane (hereinafter, referred to also as "(100) tabular grain"), which is another preferable embodiment of the host tabular grain according to the invention, will be described below. The (100) tabular grain is formed preferably in the presence of a polyvinyl alcohol derivative (hereinafter referred to as "polymer (P)"). The polymer (P) is strongly adsorbed to a silver halide grain and has a strong protective colloidal activity. The polymer (P) also inhibits a silver halide from being further laminated on an adsorbed face.

The formation of tabular nuclei of the (100) tabular grain is completed when polymer (P) is adsorbed on a pair of (100) planes, which can be main planes of the silver halide grain, and gelatin is adsorbed on the side faces (the other faces). The tabular nuclei can be formed by a method (1): adding $Ag^+$ ions and $X^-$ ions to the aqueous solution containing the polymer (P) and the gelatin in advance, or a method (2): adding $Ag^+$ ions and $X^-$ ions to the aqueous solution containing the gelatin alone, to form a fine crystal, and thereafter adding the polymer (P). When the adsorbing forces of the polymer (P) and the gelatin can be controlled skillfully in a more unstable state in the initial stage of nucleation, it is preferable to form tabular nuclei by the method (1) for the purpose of monodispersing the thickness of the grains.

The control of the adsorbing forces of the polymer (P) and the gelatin can be performed by controlling the type (molecular weight, substituent and the like) of the polymer (P) and the gelatin to be used, or amounts thereof to be used, or the pH, pAg values and the like during tabular nuclei formation. For example, as the molecular weight of the polymer (P) increases, the adsorbing force becomes stronger. In this case, it is necessary to increase the molecular weight of the gelatin or to increase the amount of gelatin to be used for balancing the adsorbing forces thereof. In nucleation, the most important thing is to realize a uniform adsorption state of the polymer (P) and the gelatin among the grains, and it is preferable that the amount of polymer (P) to be used be small. It is necessary to select the type and the amount of gelatin to be used accordingly, and to select the pH and pAg values suitable for the selected gelatin. The adsorbing force is based on the relationship between the crystal phase of an AgX grain surface, polymer (P), and gelatin, and is therefore not specifically definable.

In the ripening and growth steps after the nucleation, the balance of the adsorbing force is required to be changed according to necessity.

The ripening step is not needed when the tabular nuclei formed by the methods (1) and (2) are all preferable tabular nuclei (the state in which the polymer (P) is adsorbed on the aforementioned pair of (100) planes, which can be main planes, and the gelatin is adsorbed on the side faces (the other faces)). However, the ripening step is needed when the undesirable nucleus crystals are present. At this time, the nucleus crystals are caused to disappear by Ostwald ripening. The adsorbing force of the polymer (P) having a strong protective colloid activity is weakened, to thereby accelerate ripening. It is also preferable to provide an atmosphere, in which ripening is easily performed, by increasing the temperature, or to add $Ag^+$ ions and $X^-$ ions, to thereby accelerate ripening.

In the growth step of the (100) tabular grain, it is preferable that $Ag^+$ and $X^-$ are added in a state in which the largest difference in adsorbing forces occurs between the polymer (P) and the gelatin as much as possible, that is, in a state in which the largest difference in solubility between the main planes and the side faces occurs, in order to maintain a low supersaturation state. In order to cause a difference in the adsorbing forces to occur, it is easiest and most preferable to control the adsorbing forces of the polymer (P) and the gelatin by changing pH values.

In the (100) tabular grain formation, it is preferable that a spectral sensitizing dye is added before the grain formation is completed. Since the polymer (P) is strongly adsorbed by the silver halide grains, in order to cause the spectral sensitizing dye to be adsorbed on the main planes each having a large surface area, the spectral sensitizing dye is substituted by the polymer (P), while maintaining the silver halide surface in a dynamic state (that is, allowing a new lamination by adding silver ions and halogen ions). It is preferable that a gelatin is added in order to relatively reduce the adsorbing forces of the polymer (P), to thereby accelerate substitution.

Next, according to the invention, a process of forming a silver halide protrusion portion epitaxially junctioned on the surface of the host tabular grain will be explained. Formation of the protrusion portion may be carried out immediately after the host tabular grain is formed, or after normal desalting is carried out. It is preferable that the protrusion formation is carried out immediately after the formation of host tabular grain.

In the present invention, it is preferable that a site director is used to form a protrusion portion. A variety of site directors can be used, and a spectral sensitizing dye is preferably used as the site director. The position of the protrusion portion can be controlled by appropriately selecting the amount and type of the dye to be used. The addition amount of the dye is preferably 50% to 200% of a saturated covering amount and, more preferably, 70% to 150% thereof. Examples of usable dyes include a cyanine dye, a merocyanine dye, a composite cyanine dye, a composite merocyanine dye, a holopolar cyanine dye, a hemicyanine dye, a styryl dye and a hemioxonole dye. Most useful dyes are those classified into a cyanine dye. Any nucleus commonly used as a basic heterocyclic nucleus in cyanine dyes can be applied to these dyes. Examples of applicable nuclei are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; a nucleus in which an aliphatic hydrocarbon ring is fused to any one of the above-described nuclei; and a nucleus in which an aromatic hydrocarbon ring is fused to any one of the above-described nuclei, e.g., an indolenine nucleus, a benzindolenine nucleus, an indole nucleus, a benzoxadole nucleus, a naphthoxazole nucleus, a benzothiazole nucleus, a naphthothiazole nucleus, a benzoselenazole nucleus, a benzimidazole nucleus and a quinoline nucleus. These nuclei can each have a substituent on a carbon atom.

Although these spectral sensitizing dyes can be used singly, they may also be used in combinations. The combination of the spectral sensitizing dyes is often used for a supersensitization purpose. Representative examples of the combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707; British Nos. 1,344,281 and 1,507,803; JP-B Nos. 43-4936 and 53-12375; and JP-A Nos. 52-110618 and 52-109925. In addition to the spectral sensitizing dyes, dyes having no spectral sensitizing effect themselves or substances not substantially absorbing visible light and presenting supersensitization may be simultaneously or separately added.

In relation to the method for forming a protrusion portion, a mode in which a spectral sensitizing dye is added as a site director prior to the formation of the protrusion portion is preferable. A mode in which a spectral sensitizing dye is supplementarily added after the protrusion portion is formed is also preferable. The supplementarily added dye acts to stably-maintain the protrusion portion, and is advantageous in further enhancing the sensitivity. In this case, a dye of the same kind as that of the spectral sensitizing dye used before the protrusion portion formation may be used, or a dye of another kind may be contained.

The silver halide protrusion portion of the silver halide emulsion according to the invention can be formed by the addition of a solution containing silver nitrate. A method of simultaneously adding an aqueous silver nitrate solution and a halide solution is often used. However, the halide solution and silver nitrate solution can be added separately. The protrusion portion can be formed by the addition of silver bromide fine grains, silver iodide fine grains, or silver chloride fine grains having a grain size smaller than the thickness of the host tabular grain, or the addition of fine grains consisting of the mixed crystals thereof. In the case of the method of simultaneously adding an aqueous silver nitrate solution and a halide solution, a method of adding the solutions while maintaining the pBr value of the system constant is preferable. A time period in which the silver nitrate solution is added is, preferably, from 30 seconds to 300 minutes and, more preferably, from 1 minute to 200 minutes. The concentration of the silver nitrate solution is, preferably, 1.5 mole/liter or less and, more preferably, 1.0 mole/liter or less (hereinafter, "liter" is also denoted by "L"). The pBr value at the time of forming a silver halide protrusion portion is, preferably, 3.5 or more and, more preferably, 4.0 or more. The temperature at which the formation is carried out is preferably from 35° C. to 45° C. The pH value is, preferably, from 3 to 8 and, more preferably, from 5 to 8.

To allow the protrusion portion to contain a pseudo halide can be achieved by adding a pseudo halide salt before or during the formation of the protrusion portion, or by allowing the pseudo halide salt to be contained in the aqueous halide solution to be added at the same time when the silver nitrate is added. For example, it can be achieved by using KCN, KSCN, KSeCN and the like.

In the present invention, the pseudo halide content in the protrusion portion can be determined by such a method as described below. The tabular silver halide grain in the silver halide photographic photosensitive material is taken out by processing the photosensitive material with a protease, and centrifuging the processed material. The grains thus taken out are re-dispersed and placed on a copper mesh provided with a support film. Spot analysis of the protrusion portion of the grain, in which the spot diameter is stopped down to 2 nm or less, is performed using an analytical electron microscope, to thereby determine the pseudo halide content. The silver halide grain in which the content of the pseudo halide is already known as a calibration curve is processed in the same manner, and the ratio of Ag intensity to the pseudo halide intensity is determined in advance and, then, the pseudo halide content can be determined. In the case of $SCN^-$, for example, the content thereof can be determined from the ratio of Ag intensity to S intensity. As an analysis line source of the analytical electron microscope, a field emission-type electron beam gun with a higher electron density is more suitable than one using thermoelectrons. The pseudo halide content of the protrusion portion can easily be analyzed by stopping the spot diameter down to 1 nm or less. When the inter-grain variation coefficient of the pseudo halide content of the protrusion portion is 30% or less, usually 20 grains are measured and averaged to determine the pseudo halide content. When the inter-grain variation coefficient of the pseudo halide content of the protrusion portion is 20% or less, usually 10 grains are measured and averaged to determine the pseudo halide content. The inter-grain variation coefficient of the pseudo halide content of the protrusion portion is preferably 20% or less.

The silver halide grain to be used according to the invention preferably has a hole-trapping zone within the grain. The term "hole-trapping zone" as used herein refers to a region having a function of capturing a so-called positive hole (hole) to be generated in pairs with a photoelectron generated by optical pumping. There are various methods for providing such a hole-trapping zone. Although there are many types of methods for providing the hole-trapping zone, it is desirable according to the invention that the hole-trapping zone is provided by reduction sensitization.

According to the invention, the hole-trapping zone may be present within the grain, on a surface of the grain or the both. When the grain is an epitaxial tabular grain, the hole-trapping zone may be present in the host grain, the protruded portion, or both in the host grain and the protruded portion. However, reduced silver nuclei are easily destroyed by oxygen or moisture in the air. Thus, when an emulsion itself or a photosensitive material is preserved over a long period of time, it is preferable that the hole-trapping zone is present inside the grain or the host grain.

In general, the process for manufacturing the silver halide emulsion can be roughly divided into steps, such as grain formation, desalting and chemical sensitization. Grain formation is divided into nucleation, ripening, growth and the like. These steps need not necessarily be carried out in this order. The order may be reversed, or one step may be repeatedly performed. Basically, the silver halide emulsion is subjected to reduction sensitization at any step of the manufacturing process. Reduction sensitization may be performed at the time of nucleation, which is an early stage of grain formation, at the time of physical ripening, or at the time of grain growth. Reduction sensitization may also be performed prior to chemical sensitization other than the reduction sensitization, or after the chemical sensitization. In the case of performing chemical sensitization in combination with gold sensitization, it is preferable that the reduction sensitization is performed prior to the chemical sensitization, so as not to cause formation of undesirable fogging . The method of the reduction sensitization during the grain growth of the host grains is most preferable. The term "during the grain growth" means to include a method of performing the reduction sensitization whilst the silver halide grain is growing by physical ripening or addition of a water-soluble silver salt and water-soluble alkali halide and a method in which, during the grain growth, the reduction sensitization is performed in a state that a grain growth step is temporarily stopped, followed by further growing.

For the reduction sensitization according to the present invention, any one method can be selected from a method of adding a known reducing agent to a silver halide emulsion, a method called as a silver ripening in which grains are grown or ripened in an atmosphere of a low-pAg from pAg 1 to 7, and a method called as a high-pH ripening in which grains are grown or ripened in an atmosphere of a high-pH from pH 8 to 11. Two or more of these methods can also be used together.

The method of adding reduction sensitizers is preferable in that the level of reduction sensitization can be finely adjusted. Examples of known reduction sensitizers include silver (I) salt, amines and polyamines, a hydrazine derivative, formamidinesulfinic acid, a silane compound, a borane compound and ascorbic acid and its derivative. In the reduction sensitization to be used according to the invention, it is possible to selectively use any one compound selected from these known reduction sensitizers or to use two or more compounds thereof together. Preferred compounds as the reduction sensitizers are stannous chloride, thiourea dioxide, dimethylamineborane, and ascorbic acid and its derivative. Since the addition amount of the reduction sensitizer varies with the type of the sensitizer and the emulsion manufacturing conditions, the addition amount thereof is required to select so as to meet the type of the sensitizer and manufacturing conditions, and the amount of the sensitizer is appropriately in the range of from $1\times10^{-7}$ to $1\times10^{-3}$ mole per mole of the silver halide. When ascorbic acid compound is used, the amount thereof is in the range of from $5\times10^{-5}$ to $1\times10^{-1}$ mole per mole of the silver halide.

The reduction sensitizers are dissolved in water or an organic solvent, such as alcohols, glycols, ketones, esters, or amides, and the resultant solution can be added during the grain formation, before or after the chemical sensitization. Although the solution can be added in any step of the emulsion production process, it is particularly preferable to add the solution during the grain growth. Although the reduction sensitizer may be added to a reaction vessel in advance, addition at a proper timing during grain growth is more preferable. It is also possible to add the reduction sensitizers to an aqueous solution of a water-soluble silver salt or a water-soluble alkali halide and, then, to form grains by using this aqueous solution. Alternatively, a solution of the reduction sensitizers can preferably be added separately several times or continuously over a long period of time as the grains are formed.

In order to dispose the hole-trapping zone only inside the grain, it is effective that at least one compound selected from the compounds represented by the following formulas (A), (B) or (C) is contained in the grain:

$G\text{-}SO_2S\text{-}M$; Formula (A):

$G\text{-}SO_2S\text{-}G_1$; and Formula (B):

$G\text{-}SO_2S\text{—}L_1m\text{-}SSO_2\text{-}G_2$, Formula (C):

wherein G, $G_1$ and $G_2$ may be same with or different from one another and each represent an aliphatic group, an aromatic group, or a heterocyclic group; M represents a cation; $L_1$ represents a divalent linking group; and m represents 0 or 1. The compounds represented by the formulas (A) to (C) may be a polymer containing a divalent group derived from the structure expressed by (A) to (C) as a repeating unit. In the formula (B), G and $G_1$ may form a ring, and in the formula (C), G, $G_2$ and $L_1$ may be bonded with one another to form a ring.

The compounds represented by the formulas (A), (B) and (C) will be explained more specifically. When the G, $G_1$ and $G_2$ are each an aliphatic group, the aliphatic group is a saturated or unsaturated, straight-chained, branched, or cyclic, aliphatic hydrocarbon group and, preferably, an alkyl having 1 to 22 carbon atoms, an alkenyl or an alkynyl group having 2 to 22 carbon atoms. These groups may have a substituent. Examples of such alkyl groups include a methyl group, an ethyl group, a propyl group, a butyl group, a pentyl group, a hexyl group, an octyl group, a 2-ethylhexyl group, a decyl group, a dodecyl group, a hexadecyl group, an octadecyl group, a cyclohexyl group, an isopropyl group and a t-butyl group.

Examples of such alkenyl groups include an allyl group and a butenyl group. Examples of such alkynyl groups include a propargyl group and a butynyl group. The aromatic group of the G, $G_1$ and $G_2$ is a monocyclic or condensed-ring aromatic group and, preferably, a group having 6 to 20 carbon atoms. Examples of such aromatic groups include a phenyl group and a naphthyl group. These groups may be substituted.

The heterocyclic group of the G, $G_1$ and $G_2$ is a 3- to 15-membered heterocyclic group containing at least one element selected from nitrogen, oxygen, sulfur, selenium, and tellurium. Examples of such heterocyclic groups include a pyrrolidine ring, a piperidine ring, a pyridine ring, a tetrahydrofuran ring, a thiophene ring, an oxazole ring, a thiazole ring, an imidazole ring, a benzothiazole ring, a benzoxazole ring, a benzimidazole ring, a selenazole ring, a benzoselenazole ring, a tetrazole ring, a triazole ring, a benzotriazole ring, a tetrazole ring, an oxadiazole ring and a thiadiazole ring.

Examples of the substituents of the G, $G_1$ and $G_2$ include an alkyl group (such as a methyl group, an ethyl group or a hexyl group), an alkoxy group (such as a methoxy group, an ethoxy group or an octyloxy group), an aryl group (such as a phenyl group, a naphthyl group or a tolyl group), a hydroxy group, a halogen atom (such as fluorine, chlorine, bromine or iodine), an aryloxy group (such as a phenoxy group), an alkylthio group (such as a methylthio group or a butylthio group), an arylthio group (such as a phenylthio group), an acyl group (such as an acetyl group, a propionyl group, a butyryl group or a valeryl group), a sulfonyl group (such as a methylsulfonyl group or a phenylsulfonyl group), an acylamino group (such as an acetylamino group or a benzamino group), a sulfonylamino acid (such as methane sulfonylamino acid or benzene sulfonylamino acid), an acyloxy group (such as an acetoxy group or a benzoxy group), a carboxyl group, a cyano group, a sulfo group and an amino group.

The divalent linking group represented by $L_1$ is an atom or an atomic group containing at least one atom selected from C, N, S and O. To be more specific, examples of the divalent linking groups include, either individually or in combinations, an alkylene group, an alkenylene group, an alkynylene group, an arylene group, —O—, —S—, —NH—, —CO—, —$SO_2$— and the like.

$L_1$ is, preferably, a divalent aliphatic group or a divalent aromatic group. Examples of such divalent aliphatic groups represented by $L_1$ include —$(CH_2)n$— (n=1 to 12), —$CH_2$—CH═CH—$CH_2$—, —$CH_2C{\equiv}CCH_2$— and a xylylene group. Examples of such divalent aromatic groups include phenylene and naphthylene. These substituents may further be substituted by the aforementioned substituents.

M is, preferably, a metal ion or an organic cation. Examples of such metal ions include a lithium ion, a sodium ion and a potassium ion. Examples of such organic cations include an ammonium ion (such as ammonium, tetramethyl ammonium and tetrabutyl ammonium), a phosphonium ion (such as a tetraphenyl phosphonium) and a guanidine group.

Specific examples of the compounds represented by the formula (A), (B) or (C) are described in JP-A No. 10-268456.

The compounds represented by the formula (A), (B) or (C) can easily be synthesized by the methods as described in JP-A No. 54-1019 and British No. 972,211. The amount of the compound represented by the formula (A), (B) or (C) to be added is, preferably, $1\times10^{-7}$ to $1\times10^{-1}$ mole per mole of the silver halide, more preferably $1\times10^{-5}$ to $1\times10^{-2}$ mole/mole Ag and, particularly preferably, $1\times10^{-5}$ to $1\times10^{-3}$ mole/mole Ag.

In order to add the compounds represented by the formulas (A) to (C) during the manufacturing process, a method commonly used in the case of adding an additive to a photographic emulsion is applicable. For example, a water-soluble compound can be added, in a suitable concentration, as an aqueous solution. A water-soluble or sparingly-water-soluble compound dissolved in a suitable water-mixable organic solvent selected from, for example, alcohols, glycols, ketones, esters, amides, which does not affect adversely the photographic properties, can be added as a solution.

The compound represented by the formula (A), (B) or (C) may be added at any point before or after chemical sensitization, during the grain formation of a silver halide emulsion. The method of adding the compound before or during reduction sensitization is preferable. The method of adding the compound during the grain growth is particularly preferable.

Although adding to a reaction vessel in advance is also preferable, adding at a proper timing during grain growth is more preferable. It is also possible to add the compound represented by the formula (A), (B) or (C) to an aqueous solution of a water-soluble silver salt or a water-soluble alkali halide to form the silver halide grains by using this aqueous solution. Alternatively, a solution containing the compounds represented by the formula (A), (B) or (C) can be added separately several times or continuously over a long period of time as the grain is formed.

Among the compounds represented by the formulas (A), (B) and (C), the compounds represented by the formula (A) are most preferable according to the present invention.

As another method of forming the hole-trapping zone only inside the grain, a method of using an oxidizer is effective. The oxidizer can be either an inorganic or organic substance. Examples of such inorganic oxidizers include ozone, hydrogen peroxide and adducts thereof (for example, $NaBO_3.H_2O_2.3H_2O$, $2NaCO_3.3H_2O_2$, $Na_4P_2O_7.2H_2O_2$ and $2Na_2SO_4.H_2O_2.H_2O$), a peroxy acid salt (for example, $K_2S_4O_8$, $K_2C_2O_6$ or $K_4P_2O_8$), a peroxy complex compound (for example, $K_2[TiO_2C_2O_4]3H_2O$, $4K_2SO_4.TiO_2.OH.2H_2O$ or $Na_3[VOO_2(C_2O_4)_2.6H_2O]$), a permanganate (for example, $KMnO_4$), an oxyacid salt such as a chromate (for example, $K_2Cr_2O_7$), a halogen element such as iodine or bromine, a perhalogenate (for example, potassium periodate), a salt of a high-valence metal (for example, potassium hexacyanoferrate(II)). Examples of such organic oxidizers include quinones such as p-quinone, an organic peroxide such as peracetic acid or perbenzoic acid, and a compound to release an active halogen (for example, N-bromosuccinimide, chloramine T, or chloramine B). Preferable amount, time and method of adding these oxidizers are same as those of the compounds as represented by the formulas (A), (B) and (C).

Oxidizers according to the invention are preferably ozone, hydrogen peroxide and its adduct, a halogen element, thiosulfonate and quinones, particularly preferably thiosulfonate compounds represented by the formulas (A), (B) and (C) and, most preferably, the compounds represented by the formula (A).

In order to dispose the hole-trapping zone on the surface of grain, it is necessary that the aforementioned reduction sensitization is performed after forming 90% or more (in terms of the amount of silver) of the grain. The silver halide grain used in the present invention preferably has a temporary electron-trapping zone. The term "temporary electron-trapping zone" as used herein refers to a region having a function of temporarily trapping a photoelectron during the time until the photoelectron generated by optical pump forms a latent image in a photosensitizing step. The temporary electron-trapping zone can be realized by doping a transition metal complex.

Specific examples of such transition metal complexes in the present invention, which are preferably incorporated as a dopant into at least one of an inside and a surface of the silver halide grain are described below. The metal ions to be used as a central metal of the transition metal complex are preferably iron, ruthenium, iridium, cobalt, osmium, rhodium and palladium. These metal ions are each preferably used as a six-coordinated octahedral complex having ligands. When an inorganic compound is used as the ligand, there is preferably used a cyanide ion, a halide ion, thiocyan ion, a hydroxide ion, a peroxide ion, an azide ion, a nitrite ion, water, ammonia, a nitrosyl ion or a thionitrosyl ion. The above-described ligand may be coordinated to any of the above-described metal ions. To a coordination position of the metal ion, same types of ligands may be coordinated or different types of ligands may simultaneously be coordinated. Further, an organic compound can be used as a ligand. When the organic compound is used as a ligand, at least one of a chain compound in which a main chain has 5 or less carbon atoms and a 5-membered or 6-membered heterocyclic compound is preferable. Among these compounds, a compound having a nitrogen atom, a phosphorus atom, an oxygen atom or a sulfur atom in the molecule as a coordination atom to a metal is more preferable, and furan, thiophene, oxazole, isooxazole, thiazole, isothiazole, imidazole, pyrazole, triazole, furazan, pyran, pyridine, pyridazine, pyrimidine or pyrazine is particularly preferable. Further, a compound obtained by using any one of these compounds as a basic skeleton and further introducing a substituent into the skeleton is also preferred. The above-described transition metal complex is incorporated preferably in an amount of from $1\times10^{-10}$ to $1\times10^{-2}$ mole per mole of silver and, more preferably, in an amount of from $1\times10^{-8}$ to $1\times10^{-3}$ mole per mole of silver.

In the transition metal complex, iron, ruthenium, and iridium are particularly preferable as metal ions to be used as the central metals. When the central metal is iron or ruthenium, as a combination with the ligands, a combination of iron ion and a cyanide ion, a combination of ruthenium ion and a cyanide ion are preferably mentioned. In these combinations, it is preferable that the cyanide ions amount to the majority of the coordination number to iron or ruthenium which is a central metal. It is more preferable that the remaining coordination sites are occupied by any one of thiocyan, ammonia, water a nitrosyl ion, dimethyl sulfoxide, pyridine, pyrazine and 4,4'-bipyridine. It is most preferable that six coordination sites of the central metal are all occupied by the cyanide ions to form a hexacyanoiron complex or a hexacyanoruthenium complex. Preferable specific examples when iron or ruthenium is used as a central metal include $[Fe(CN)_6]^{4-}$, $[Fe(CN)_6]^{3-}$, $[Ru(CN)_6]^{4-}$, $[Fe(pyrazine)(CN)_5]^{4-}$, $[Fe(CO)(CN)_5]^{3-}$, $[RuF_2(CN)_4]^{4-}$, $[Ru(CN)_5(OCN)]^{4-}$, $[Ru(CN)_5(N_3)]^{4-}$, $[Fe(CN)_3Cl_3]^{3-}$ and $[Ru(CO)_2(CN)_4]^{1-}$. On the other hand when iridium is used as the central metal, the ligands are preferably a fluoride ion, a chloride ion, a bromide ion, an iodide ion, a cyanide ion and a thiocyanide ion. Among them, a chloride ion and a bromide ion are more preferable. Further, it is preferable that any one of these ligands amount to the majority of the coordination number to iridium and is also preferable that the remaining coordination sites are occupied by any one of thiocyan, ammonia, water a nitrosyl ion, dimethyl sulfoxide, pyridine, pyrazine and 4,4'-bipyridine. Preferable specific examples of metal complexes when iridium is used as the central metal include $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, $[IrBr_3(H_2O)_3]^{+}$, $[Ir(CN)_6]^{3-}$, $[IrBr(CN)_5]^{3-}$, $[IrBr_2(CN)_4]^{3-}$, $[Ir(CN)_5(H_2O)]^{2-}$, $[Ir(CN)_4(ozalate)]^{3-}$ and $[Ir(NCS)_6]^{3-}$.

Next, the chemical sensitization of the silver halide grains according to the present invention will be described. In the present invention, the chemical sensitization may be performed either before or after desalting. One chemical sensitization which can be preferably performed according to the present invention is chalcogen sensitization, noble metal sensitization, or the combination thereof. Chemical sensitization can be performed by using an active gelatin as described in T. H. James, The Theory of the Photographic Process, 4th ed., Macmillan, 1977, pp. 67 to 76. Chemical sensitization can also be performed by using any of sulfur, selenium, tellurium, gold, platinum, palladium, and iridium, or by using the combination of a plurality of these sensitizers at a pAg value of 5 to 10, a pH value of 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent No. 1,315,755. In noble metal sensitization, salts of noble metals, such as gold, platinum, palladium, and iridium, can be used. In particular, gold sensitization, palladium sensitization, or the combination of the two is preferred. In gold sensitization, it is possible to use known compounds, such as chloroauric acid, potassium chloroaurate, potassium aurithiocyanate, gold sulfide, and gold selenide, or a mesoion gold compound as described in U.S. Pat. No. 5,220,030 or an azole gold compound and the like as described in U.S. Pat. No. 5,049,484. A palladium compound, on this occasion, means a divalent or tetravalent salt of palladium. Preferred palladium compounds are represented by $R_2PdX_6$ or $R_2PdX_4$, wherein R represents a hydrogen atom, an alkali metal atom, or an ammonium group;and X represents a halogen atom, i.e., a chlorine, bromine, or iodine atom. M ore specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$. The gold compound and the palladium compound are preferably used in combination with thiocyanate or selenocyanate.

In the emulsion according to the invention, the gold sensitization is preferably combined. The preferable amount of the gold sensitizer is in the range of from $1\times10^{-3}$ to $1\times10^{-7}$ mole, more preferably in the range of from $1\times10^{-4}$ to $5\times10^{-7}$ per mole of silver halide. The preferable amount of the palladium compound is in the range of from $1\times10^{-3}$ to $5\times10^{-7}$ mole per mole of silver halide. The preferable amounts of the thiocyan compound and selenocyan compound are in the range of from $5\times10^{-2}$ to $1\times10^{-6}$ mole per mole of silver halide.

As for sulfur sensitizers, sodium thiosulfate, a thiourea type compound, a rhodanine type compound and sulfur-containing compounds as described in U.S. Pat. Nos. 3,857,711, 4,266,018, and 4,054,457 can be used. The chemical sensitization can also be performed in the presence of a so-called chemical sensitization aid. As for useful chemical sensitization aids, compounds, such as azaindene, azapyridazine, and azapyrimidine, which are known as compounds capable of suppressing fog and increasing sensitivity in the process of chemical sensitization can be used. Examples of modifiers of the chemical sensitization aids are described in U.S. Pat. Nos. 2,131,038, 3,411,914 and 3,554,757; JP-A No. 58-126526; and G. F. Duffin, Photographic Emulsion Chemistry, pp. 138 to 143. The preferable amount of the sulfur sensitizer is $1\times10^{-4}$ to $1\times10^{-7}$ and, more preferably, $1\times10^{-5}$ to $5\times10^{-7}$ per mole of silver halide.

The silver halide emulsions according to the invention are preferably subjected to selenium sensitization. Selenium compounds disclosed in hitherto published patent documents can be used as the selenium sensitizer in the present invention. In the use of labile selenium compound and/or non-abile selenium compound, generally, it is added to an emulsion and the emulsion is agitated at high temperature (preferably 40° C. or above) for a given period of time. Compounds described in, for example, JP-B Nos. 44-15748 and 43-13489; and JP-A Nos. 4-25832 and 4-109240 are preferably used as the labile selenium compound.

Specific examples of the labile selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2,6-dimethoxybenzoyl) selenide), selenophosphates, phosphine selenides and colloidal metal selenium.

The labile selenium compounds, although preferred types thereof are as mentioned above, are not limited thereto. It is generally understood by persons of ordinary skill in the art to which the invention pertains that the structure of the labile selenium compound as a photographic emulsion sensitizer is not so important as long as the selenium is labile and that the labile selenium compound plays no other role than having its selenium portion carried by organic portions of the selenium sensitizer molecules and causing it to present in unstable form in the emulsion. According to the invention, the labile selenium compounds of this broad concept can be used advantageously.

Compounds described in JP-B Nos. 46-4553, 52-34492 and 52-34491 can be used as the non-labile selenium compound according to the invention. Examples of the non-labile selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in water, or, a single or mixed organic solvent, such as methanol or ethanol, and added at the time of chemical sensitization. They are preferably added before chemical sensitization. The number of selenium sensitizers to be used is not limited to one, and two or more of the above sensitizers can be used in combinations. The combined use of the labile selenium compound and the non-labile selenium compound is preferable.

Although the amount of the selenium sensitizer to be added in the present invention varies with the activity of the selenium sensitizer to be used, type or size of the silver halide, temperature or time of ripening and the like, $1\times10^{-8}$ mole per mole of a silver halide or more is preferable. $1\times10^{-7}$ mole or more, and $5\times10^{-5}$ mole or less is more preferable. When the selenium sensitizer is used, chemical ripening is preferably performed in the range of from 40° C. to 80° C. The pAg value and pH value are freely chosen. Concerning the pH value, for example, the effect of the present invention can be obtained over a wide range of from 4 to 9.

The selenium sensitization is preferably performed by either sulfur sensitization or noble metal sensitization, or in combination thereof According to the invention, it is preferable that thiocyanate is added to the silver halide emulsion at the time of chemical sensitization. As the thiocyanate, potassium thiocyanate, sodium thiocyanate, ammonium thiocyanate and the like, are used. The thiocyanate is usually dissolved in an aqueous solution or a water-soluble solvent before being added. The amount of the thiocyanate to be added is from $1\times10^{-5}$ mole to $1\times10^{-2}$ mole per mole of the silver halide and, more preferably, from $5\times10^{-5}$ mole to $5\times10^{-3}$ mole per mole of the silver halide.

In the emulsion according to the invention, the surface of a grain or any inside position from the surface of the grain may be chemically sensitized. In the case of chemically sensitizing the interior of the grain, reference can be made to a method as described in JP-A No. 63-264740. As the chloride ion content of the epitaxially junctioned silver halide protrusion portion becomes lower, the inner portion of the grain tends to be chemically sensitized. When the protrusion portion is formed in the presence of thiocyante ions, the further inner portions of the grain tend to be chemically sensitized.

The tabular silver halide grain used in the present invention is spectrally sensitized by a spectral sensitizing dye. An amount of the spectral sensitizing dye to be added is, preferably, from $1\times10^{-4}$ mole to $1\times10^{-2}$ mole and, more preferably, from $2\times10^{-4}$ mole to $5\times10^{-3}$ mole per mole of silver.

The total amount of the spectral sensitizing dye to be contained in the photosensitive material of the present invention is preferably from 10 mg to 200 mg and, more preferably, from 15 mg to 100 mg.

Next, another preferred embodiment of the silver halide emulsion according to the present invention will be explained. It is preferable that an adequate amount of at least one of calcium ion and magnesium ion is contained in the silver halide emulsion used in the present invention, so that the graininess and the image quality are increased, and the storability is also improved. The adequate amount is 400 to 2500 ppm of calcium and/or 50 to 2500 ppm of magnesium and, more preferably, 500 to 2000 ppm of calcium and 200 to 2000 ppm of magnesium. The term "400 to 2500 ppm of calcium and/or 50 to 2500 ppm of magnesium" is herein defined as requiring that the concentration of at least one of calcium and magnesium is within the specified range. When the calcium or magnesium content is higher than these values, an inorganic salt originally contained in the calcium salt, magnesium salt, gelatin or the like may be precipitated. This results in defects in photosensitive material a problem in the process of manufacturing the photosensitive material, which is not preferable. The term "calcium or magnesium content" as used therein refers to the concentration per unit mass of the emulsion by expressing all the compounds containing calcium or magnesium, such as calcium ions, magnesium ions, calcium salt, magnesium salt, in mass in terms of calcium atoms or magnesium atoms.

Calcium to be added to the silver halide emulsion according to the invention can be added at any point in the emulsion producing process; however, an embodiment in which calcium is added prior to the formation of the protrusion portion of the silver halide is preferable. Further, another embodiment in which calcium is supplementarily added after the formation of the protrusion portion is also preferable.

Calcium is ordinarily added in the form of a calcium salt. As for such calcium salts, calcium nitrate and calcium chloride are preferable and calcium nitrate is most preferable. Similarly, a magnesium content can be controlled by the addition of a magnesium salt at the time of producing the emulsion. As for such magnesium salts, magnesium nitrate, magnesium sulfate and magnesium chloride are preferable, and magnesium nitrate is most preferable. As a quantitative analysis for determining the calcium or magnesium content, an ICP emission spectral analysis method may be used. The calcium and magnesium can be used alone or in combination, but it is preferable that calcium is contained.

As a compound especially useful for the purpose of reducing fog and suppressing increase in fog during storage, a mercaptotetrazole compound having a water-soluble group as described in JP-A No. 4-16838 is used. This publication discloses that the storability is improved by using a mercaptotetrazole compound and a mercaptothiadiazole compound in combination.

Photographic emulsions used in the present invention can contain various compounds in order to prevent fog during the manufacturing process, storage, or photographic processing of a photosensitive material, or to stabilize photographic properties. That is, it is possible to add many compounds known as antifoggants or stabilizers, e.g., thiazoles (such as benzothiazolium salt); nitroimidazoles; nitrobenzimidazoles; chlorobenzimidazoles; bromobenzimidazoles; mercaptothiazoles; mercaptobenzothiazoles; mercaptobenzimidazoles; mercaptothiadiazoles; aminotriazoles; benzotriazoles; nitrobenzotriazoles; mercaptotetrazoles (particularly 1-phenyl-5-mercaptotetrazole); mercaptopyrimidines; mercaptotriazines; a thioketo compound such as oxadolinethione; azaindenes such as triazaindenes, tetrazaindenes (particularly 4-hydroxy-substituted(1,3,3a,7)tetrazaindenes) and pentazaindenes. For example, compounds as described in U.S. Pat. Nos. 3,954,474 and 3,982,947 and JP-B No. 52-28660 can be used. One preferred compound is described in JP-A No. 63-212932. Antifoggants and stabilizers can be added at various steps of the production of the photosensitive material, such as before, during, and after grain formation, during washing with water, during dispersion after the washing, before, during, and after chemical sensitization, and before coating, in accordance with the intended purposes. The antifoggants and stabilizers can be added during preparation of the emulsion to exert their inherent fog preventing effect and stabilizing effect. In addition, the antifoggants and stabilizers can be used for various purposes of, for example, controlling the crystal habit of grains, decreasing the grain size, decreasing the solubility of grains, controlling chemical sensitization, and controlling the arrangement of dye molecules.

It is advantageous to use gelatin as a protective colloid for use in the preparation of the emulsions according to the invention or as a binder for other hydrophilic colloid layers. However, other hydrophilic colloids can also be used in place of gelatin. Examples of such hydrophilic colloids include a gelatin derivative; a graft polymer of gelatin and another high polymer; proteins such as albumin and casein; cellulose derivatives such as hydroxyethyl cellulose, carboxymethyl cellulose, and cellulose sulfates ester; sugar derivatives such as sodium alginate and a starch derivative; and a variety of synthetic hydrophilic high polymers such as homopolymers or copolymers, for example, polyvinyl alcohol, polyvinyl alcohol partial acetal, poly-N-vinylpyrrolidone, polyacrylic acid, polymethacrylic acid, polyacrylamide, polyvinylimidazole and polyvinyl pyrazole.

Examples of gelatin are lime-processed gelatin, acid processed gelatin, and enzyme-processed gelatin as described in Bull. Soc. Sci. Photo. Japan. No. 16, p. 30 (1966). In addition, a hydrolyzed product or an enzyme-decomposed product of gelatin can also be used.

It is preferable to wash the emulsion with water according to the invention to desalt, and to prepare a protective colloid dispersion by using a newly prepared protective colloid. Although the temperature of washing can be selected in accordance with the intended use, it is preferably in the range of 5° C. to 50° C. Although the pH value at the time of washing can also be selected in accordance with the intended use, it is preferably 2 to 10, and more preferably, 3 to 8. The pAg value at the time of washing is, preferably, 5 to 10, though it can also be selected in accordance with the intended use. The washing method can be selected from noodle washing, dialysis using a semipermeable membrane, centrifugal separation, flocculation sedimentation, and ion exchange. The flocculation sedimentation can be selected from a method using sulfate, a method using an organic solvent, a method using a water-soluble polymer, and a method using a gelatin derivative.

According to the invention, a known interimage effect controlling means can also be applied in combination. For example, it is possible to preferably use surface-fogged silver halide grains as described in U.S. Pat. No. 4,082,553, internally fogged silver halide grains as described in U.S. Pat. No. 4,626,498 and JP-A No. 59-214852, and colloidal silver grains used in a photosensitive silver halide emulsion layer and/or a substantially non-photosensitive hydrophilic colloidal silver layers.

The term "internally fogged or surface-fogged silver halide grain" as used herein means a silver halide grain which is uniformly developable (non-imagewise) regardless of a non-exposed portion or an exposed portion of the photosensitive material. A method of preparing the internally fogged or surface-fogged silver halide grain is described in JP-A No. 59-214852 and U.S. Pat. No. 4,626,498. These fogged silver halide grains may be any of silver chloride, silver bromide, silver chlorobromide, and silver iodobromide. However, silver bromide or silver iodobromide is preferable. In this case, the content of the iodide is, preferably, 5% by mole or less and, more preferably, 2% by mole or less. Further, these fogged silver halide grains may contain an internal structure having different halide composition within the grains.

A grain size (equivalent-spherical diameter) of any of the fogged silver halide grains of the present invention is not particularly limited, and is preferably smaller than an average size of the silver halide grains of a color-sensitive emulsion layer unit to which these fogged silver halide grains are added. When these fogged silver halide grains are added to a layer adjacent to the color-sensitive emulsion layer unit, is preferably smaller than the average size of the silver halide grains of the adjacent emulsion layer. Specifically, the grain size of these fogged silver halide grains is preferably from 0.05 μm to 0.5 μm, more preferably from 0.05 μm to 0.3 μm and, most preferably, 0.05 μm to 0.2 μm.

Further, these fogged silver halide grains are not particularly limited in shapes and can be regular grains or irregular grains. Still further, although a grain size distribution of these fogged silver halide grains may be multidisperse, it is preferably monodisperse. Although an amount of these fogged silver halide grains to be used can freely vary with the necessity in the present invention, it is preferably from 0.05% by mole to 50% by mole and, more preferably, from 0.1% by mole to 25% by mole in terms of the ratio the fogged silver halide to a total amount of photosensitive silver halide contained in all layers of the color reversal photographic material according to the invention.

Although this colloidal silver may have any of yellow, brown and black colors, it is preferred to use yellow colored colloidal silver whose maximum absorption wavelength is in the range of from 400 to 500 nm, and it is more preferred to use yellow colored colloidal silver whose maximum absorption wavelength is in the range of from 430 to 460 nm. Preparation of various types of colloidal silver is described in, for example, "Colloidal Elements" written by Weiser and published by Wiley & Sons, New York in 1933 (yellow colloidal silver by the Carey Lea dextrin reduction method), DE No. 1,096,193 (brown and black colloidal silvers), or U.S. Pat. No. 2,688,601 (blue colloidal silver). According to the invention, the suitable amount of colloidal silver for each layer into which the colloidal silver is added is preferably in the range of from 0.001 to 0.4 $g/m^2$ and, more preferably, from 0.003 to 0.3 $g/m^2$.

According to the invention, the surface-fogged and/or internally fogged silver halide grain, or the colloidal silver may be contained in any one of color-sensitive emulsion layer units or layers adjacent thereto and is preferably contained in at least one layer of all the color-sensitive emulsion layer units and/or at least one layer of all the layers adjacent to all the color-sensitive emulsion layer units. The surface-fogged silver halide grain, internally-fogged silver halide grain and the colloidal silver may be used each individually of in any combinations thereof.

As one of the interimage effect control means of the present invention, it is preferable to use an internal latent image type silver halide grain, which mainly forms a latent image in the interior of the grain, in at least one layer of the color-sensitive emulsion layer unit. As the internal latent image type silver halide grain, a core/shell internal latent image type emulsion as described in JP-A No. 63-264740 is preferably used. A method of preparing this core/shell internal latent image type emulsion is described in JP-A No. 59-133542. Although the thickness of a shell of this emulsion is not specifically limited, but it is, preferably, 3 to 40 nm and, most preferably, 5 to 20 nm. When each color-sensitive emulsion layer unit comprises two or more layers which are different in sensitivity, spectral sensitivity and the like from one another, it is preferable that the internal latent image type silver halide grain is contained in at least one of a lowest sensitive emulsion layer and a next-to-lowest sensitive emulsion layer of each color-sensitive emulsion layer unit.

As one of the interimage effect control means of the present invention, it is preferable to allow DIR compounds as described in U.S. Pat. Nos. 3,364,022 and 3,379,529; JP-B Nos. 6-21942 and 6-21943; and JP-A Nos. 4-151144 and 4-359248 to be contained in the color reversal photographic material. These DIR compounds may be added to at least one of a desired emulsion layer and non-photosensitive layer. An amount of such DIR compounds to be added is preferably in the range of from 0.01 millimole/$m^2$ to 0.2 millimole/$m^2$.

Applicable various techniques, and inorganic and organic materials usable in the silver halide photographic material and silver halide emulsions used therein are generally those as described in Research Disclosure Item 308119 (1989), Item 37038 (1995), and Item 40145 (1997).

In addition, more specifically, techniques and inorganic and organic materials that can be used in the color photographic photosensitive materials to which the silver halide grain emulsion can be applied are described in the portions of EP436,938A2 and patents cited below.

| Items | Corresponding portions |
|---|---|
| 1) Layer configuration: | page 146, line 34 to page 147, line 25 |
| 2) Silver halide emulsion usable together | page 147, line 26 to page 148 line 12 |
| 3) Yellow coupler usable together | page 137, line 35 to page 146, line 33, and page 149, lines 21 to 23 |
| 4) Magenta coupler usable together | page 149, lines 24 to 28; EP421,453A1, page 3, line 5 to page 25, line 55 |
| 5) Cyan coupler usable together | page 149, lines 29 to 33; EP432,804A2, page 3, line 28 to page 40, line 2 |
| 6) Polymer coupler | page 149, lines 34 to 38; EP435,334A2, page 113, line 39 to page 123, line 37 |
| 7) Colored coupler | page 53, line 42 to page 137, line 34, and page 149, lines 39 to 45 |
| 8) Functional coupler usable together | page 7, line 1 to page 53, line 41, and page 149, line 46 to page 150, line 3; EP435,334A2, page 3, line 1 to page 29, line 50 |
| 9) Antiseptic and mildewproofing agent | page 150, lines 25 to 28 |
| 10) Formalin scavenger | page 149, lines 15 to 17 |

-continued

| Items | Corresponding portions |
|---|---|
| 11) Other additive usable together | page 153, lines 38 to 47; EP421,453A1, page 75, line 21 to page 84, line 56, and page 27, line 40 to page 37, line 40 |
| 12) Dispersion method | page 150, lines 4 to 24 |
| 13) Support | page 150, lines 32 to 34 |
| 14) Film thickness-film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing · stabilizing step | page 153, lines 3 to 37 |

EXAMPLES

Hereinafter, the present invention will be described with reference to embodiments but is not limited thereto.

Example 1

—Preparation of Sample 101—

(1) Preparation of Triacetyl Cellulose Film

Triacetyl cellulose was dissolved (13% by mass) in dichloromethane/methanol=92/8 (mass ratio), and, then, triphenyl phosphate and biphenyldiphenyl phosphate with a mass ratio being 2:1 as plasticizers were added to the resultant solution such that the total amount of the plasticizers came to be 14% relative to triacetyl cellulose and, thereafter, a triacetyl cellulose film was prepared by using a band method according to a normal solvent casting method. Thickness of a support after drying was 97 μm.

(2) Content of Undercoat Layer

Both faces of the thus prepared triacetyl cellulose film were applied with an undercoat by using an undercoat solution having a composition as described below. Numerals show a mass of each component contained per liter of the undercoat solution.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water up to 1.0 L | As required, to make the total |

(3) Coating of Back Layer

A back layer as described below was applied onto one surface of the resultant undercoated support.

| 1st layer | |
|---|---|
| Binder: acid-processed gelatin (isoelectric point 9.0) | 1.00 g |

-continued

| | |
|---|---|
| Polymer latex: P-2 (average grain diameter 0.1 μm) | 0.13 g |
| Polymer latex: P-4 (average grain diameter 0.2 μm) | 0.23 g |
| Ultraviolet absorbent U-1 | 0.030 g |
| Ultraviolet absorbent U-2 | 0.010 g |
| Ultraviolet absorbent U-3 | 0.010 g |
| Ultraviolet absorbent U-4 | 0.020 g |
| High-boiling organic solvent Oil-2 | 0.030 g |
| Surfactant W-2 | 0.010 g |
| Surfactant W-4 | 3.0 mg |
| 2nd layer | |
| Binder: acid-processed gelatin (isoelectric point 9.0) | 3.10 g |
| Polymer latex: P-4 (average grain diameter 0.2 μm) | 0.11 g |
| Ultraviolet absorbent U-1 | 0.030 g |
| Ultraviolet absorbent U-3 | 0.010 g |
| Ultraviolet absorbent U-4 | 0.020 g |
| High-boiling organic solvent Oil-2 | 0.030 g |
| Surfactant W-2 | 0.010 g |
| Surfactant W-4 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer | |
| Binder: acid-processed gelatin (isoelectric point 9.0) | 3.30 g |
| Surfactant W-2 | 0.020 g |
| Potassium sulfate | 0.30 g |
| Sodium hydroxide | 0.03 g |
| 4th layer | |
| Binder: lime-processed gelatin (isoelectric point 5.4) | 1.15 g |
| 1:9 copolymer of methacrylic acid and methyl methacrylate (average grain diameter 2.0 μm) | 0.040 g |
| 6:4 copolymer of methacrylic acid and methyl methacrylate (average grain diameter 2.0 μm) | 0.030 g |
| Surfactant W-2 | 0.060 g |
| Surfactant W-l | 7.0 mg |
| Hardener H-l | 0.23 g |

(4) Coating of Photosensitive Emulsion Layer

The photosensitive emulsion layers as described below were applied onto the other face of the undercoated support opposite to the face applied with the back layers, to thereby prepare Sample 101. Numerals show an amount of each component to be added per $m^2$. Further, effects of compounds thus added are not limited to specified applications.

As for gelatin as described below, that having a molecular weight of from 100000 to 200000 was used. Contents of main metal ions were as follows: calcium: 2500 to 3000 ppm; iron: 1 to 7 ppm; and sodium: 1500 to 3000 ppm. Gelatin having a calcium content of 1000 ppm or less was simultaneously used.

Firstly, organic compounds to be contained were dispersed together with gelatin to prepare respective emulsions (surfactants used for emulsification were described in an explanation of each layer). Next, a photosensitive emulsion and yellow colloidal silver were each dispersed together with gelatin to prepare respective emulsions. Subsequently, the emulsions containing the organic compounds and the photosensitive emulsions or the yellow colloidal silver dispersion were mixed with one another to prepare coating solutions such that respective addition amounts of components as described below was able to be obtained. The thus prepared coating solutions were provided for applying each layer. Cpd-H, O, P, Q, Dye D-1, 2, 3, 5, 6, 8, 9, 10, H-1, P-3, and F-1 to 9 were each dissolved in water or an appropriate water-compatible organic solvent such as methanol, dimethyl formamide, ethanol or dimethyl acetamide and, then, the resultant solution was added to a coating solution for each layer. The resultant coating solution for each layer was applied and, then, dried in a multi-stage drying step at a temperature maintained in the range of from 10° C. to 45° C., to thereby prepare samples.

| | |
|---|---|
| 1st layer: Antihalation layer | |
| Black colloidal silver | 0.20 g |
| Gelatin | 2.20 g |
| Compound Cpd-B | 0.010 g |
| Ultraviolet absorbent U-1 | 0.050 g |
| Ultraviolet absorbent U-3 | 0.020 g |
| Ultraviolet absorbent U-4 | 0.020 g |
| Ultraviolet absorbent U-5 | 0.010 g |
| Ultraviolet absorbent U-2 | 0.070 g |
| Compound Cpd-F | 0.20 g |
| High-boiling point organic solvent Oil-2 | 0.020 g |
| High-boiling point organic solvent Oil-6 | 0.020 g |
| Dye D-4 | 1.0 mg |
| Dye D-8 | 1.0 mg |
| Fine crystal solid dispersion of Dye E-1 | 0.05 g |
| W-3 | 0.030 g |
| 2nd layer: Interlayer | |
| Gelatin | 0.4 g |
| Compound Cpd-F | 0.050 g |
| Compound Cpd-R | 0.020 g |
| Compound Cpd-S | 0.020 g |
| High-boiling point organic solvent Oil-6 | 0.010 g |
| High-boiling point organic solvent Oil-7 | 5.0 mg |
| High-boiling point organic solvent Oil-8 | 0.020 g |
| Dye D-11 | 2.0 mg |
| Dye D-7 | 4.0 mg |
| W-3 | 0.010 g |
| 3rd layer: Interlayer | |
| Gelatin | 0.4 g |
| 4th layer: Interlayer | |
| Gelatin | 1.50 g |
| Compound Cpd-M | 0.10 g |
| Compound Cpd-D | 0.010 g |
| Compound Cpd-K | 3.0 mg |
| Compound Cpd-O | 3.0 mg |
| Compound Cpd-T | 5.0 mg |
| Ultraviolet absorbent U-6 | 0.010 g |
| High-boiling point organic solvent Oil-6 | 0.10 g |
| High-boiling point organic solvent Oil-3 | 0.010 g |
| High-boiling point organic solvent Oil-4 | 0.010 g |
| W-3 | 0.015 g |
| W-2 | 3.0 mg |

-continued

5th layer: Low-speed red-sensitive emulsion layer

| | | |
|---|---|---|
| Emulsion A | silver amount | 0.20 g |
| Emulsion B | silver amount | 0.20 g |
| Gelatin | | 0.60 g |
| Coupler C-1 | | 0.15 g |
| Coupler C-2 | | 7.0 mg |
| Ultraviolet absorbent U-2 | | 3.0 mg |
| Compound Cpd-J | | 2.0 mg |
| High-boiling point organic solvent Oil-5 | | 0.050 g |
| High-boiling point organic solvent Oil-10 | | 0.020 g |
| W-3 | | 0.020 g |
| W-2 | | 4.0 mg |

6th layer: Medium-speed red-sensitive emulsion layer

| | | |
|---|---|---|
| Emulsion B | silver amount | 0.20 g |
| Emulsion C | silver amount | 0.20 g |
| Internally fogged silver bromide emulsion (cubic, average equivalent-sphere grain diameter 0.11 μm) | silver amount | 0.010 g |
| Gelatin | | 0.60 g |
| Coupler C-1 | | 0.15 g |
| Coupler C-2 | | 7.0 mg |
| High-boiling point organic solvent Oil-5 | | 0.050 g |
| High-boiling point organic solvent Oil-10 | | 0.020 g |
| Compound Cpd-T | | 2.0 mg |
| W-3 | | 0.020 g |
| W-2 | | 4.0 mg |

7th layer: High-speed red-sensitive emulsion layer

| | | |
|---|---|---|
| Emulsion D | silver amount | 0.40 g |
| Gelatin | | 1.50 g |
| Coupler C-1 | | 0.70 g |
| Coupler C-2 | | 0.025 g |
| Coupler C-3 | | 0.020 g |
| Coupler C-8 | | 3.0 mg |
| Ultraviolet absorbent U-1 | | 0.010 g |
| High-boiling point organic solvent Oil-5 | | 0.25 g |
| High-boiling point organic solvent Oil-9 | | 0.05 g |
| High-boiling point organic solvent Oil-10 | | 0.10 g |
| Compound Cpd-D | | 3.0 mg |
| Compound Cpd-L | | 1.0 g |
| Compound Cpd-T | | 0.050 g |
| Additive P-1 | | 0.010 g |
| Additive P-3 | | 0.010 g |
| Dye D-8 | | 1.0 mg |
| W-3 | | 0.090 g |
| W-2 | | 0.020 g |

8th layer: Interlayer

| | | |
|---|---|---|
| Gelatin | | 0.50 g |
| Additive P-2 | | 0.030 g |
| Dye D-5 | | 0.010 g |
| Dye D-9 | | 6.0 mg |
| Compound Cpd-I | | 0.020 g |
| Compound Cpd-O | | 3.0 mg |
| Compound Cpd-P | | 5.0 mg |

9th layer: Interlayer

| | | |
|---|---|---|
| Yellow colloidal silver | silver amount | 8.0 mg |
| Gelatin | | 1.20 g |
| Additive P-2 | | 0.010 g |
| Compound Cpd-A | | 0.030 g |
| Compound Cpd-M | | 0.10 g |
| Compound Cpd-O | | 2.0 mg |
| Ultraviolet absorbent U-1 | | 0.010 g |
| Ultraviolet absorbent U-2 | | 0.010 g |
| Ultraviolet absorbent U-5 | | 5.0 mg |
| High-boiling point organic solvent Oil-3 | | 0.010 g |
| High-boiling point organic solvent Oil-6 | | 0.10 g |
| W-3 | | 0.020 g |

10th layer: Low-speed green-sensitive emulsion layer

| | | |
|---|---|---|
| Emulsion E | silver amount | 0.20 g |
| Emulsion F | silver amount | 0.15 g |
| Emulsion G | silver amount | 0.15 g |
| Gelatin | | 1.00 g |
| coupler C-4 | | 0.060 g |
| coupler C-5 | | 0.10 g |

-continued

| | | |
|---|---|---|
| Compound Cpd-B | | 0.020 g |
| Compound Cpd-G | | 2.5 mg |
| Compound Cpd-K | | 1.0 mg |
| High-boiling point organic solvent Oil-2 | | 0.010 g |
| High-boiling point organic solvent Oil-5 | | 0.020 g |
| W-3 | | 5.0 mg |
| W-2 | | 5.0 mg |

11th layer: Medium-speed green-sensitive emulsion layer

| | | |
|---|---|---|
| Emulsion G | silver amount | 0.20 g |
| Emulsion H | silver amount | 0.20 g |
| Internally fogged Silver bromide emulsion (cubic, average equivalent-sphere grain diameter 0.11 μm) | silver amount | 0.010 g |
| Gelatin | | 0.70 g |
| Coupler C-4 | | 0.10 g |
| Coupler C-5 | | 0.050 g |
| Coupler C-6 | | 0.010 g |
| Compound Cpd-B | | 0.020 g |
| Compound Cpd-U | | 8.0 mg |
| High-boiling point organic solvent Oil-2 | | 0.010 g |
| High-boiling point organic solvent Oil-5 | | 0.020 g |
| Additive P-1 | | 0.010 g |
| W-3 | | 7.0 mg |
| W-2 | | 7.0 mg |

12th layer: High-speed green-sensitive emulsion layer

| | | |
|---|---|---|
| Emulsion I | silver amount | 0.40 g |
| Silver bromide emulsion in which the inside and the surface were fogged (cubic, average equivalent-sphere grain diameter 0.10 μm) | silver amount | 5.0 mg |
| Gelatin | | 1.20 g |
| Coupler C-4 | | 0.50 g |
| Coupler C-5 | | 0.30 g |
| Coupler C-7 | | 0.10 g |
| Compound Cpd-B | | 0.030 g |
| Compound Cpd-U | | 0.020 g |
| High-boiling point organic solvent Oil-5 | | 0.15 g |
| Additive P-1 | | 0.030 g |
| W-3 | | 0.020 g |
| W-2 | | 0.040 g |

13th layer: Yellow filter layer

| | | |
|---|---|---|
| Yellow colloidal silver | silver amount | 1.0 mg |
| Gelatin | | 1.0 g |
| Compound Cpd-C | | 0.010 g |
| Compound Cpd-M | | 0.020 g |
| High-boiling point organic solvent Oil-1 | | 0.020 g |
| High-boiling point organic solvent Oil-6 | | 0.020 g |
| Fine crystal solid dispersion of Dye E-2 | | 0.25 g |
| W-3 | | 6.0 mg |

14th layer: Low-speed blue-sensitive emulsion layer

| | | |
|---|---|---|
| Emulsion J | silver amount | 0.10 g |
| Emulsion K | silver amount | 0.20 g |
| Emulsion L | silver amount | 0.15 g |
| Silver bromide emulsion in which the inside and the surface were fogged (cubic, average equivalent-sphere grain diameter 0.11 μm) | silver amount | 0.010 g |
| Gelatin | | 0.80 g |
| Coupler C-8 | | 0.020 g |
| Coupler C-9 | | 0.020 g |
| Coupler C-10 | | 0.20 g |
| Compound Cpd-B | | 0.010 g |
| Compound Cpd-I | | 8.0 mg |
| Compound Cpd-K | | 2.0 mg |
| Ultraviolet absorbent U-5 | | 0.010 g |
| Additive P-1 | | 0.020 g |
| W-3 | | 0.025 g |

15th layer: Medium-speed blue-sensitive emulsion layer

| | | |
|---|---|---|
| Emulsion L | silver amount | 0.15 g |
| Emulsion M | silver amount | 0.20 g |
| Gelatin | | 0.80 g g |
| Coupler C-8 | | 0.030 g |
| Coupler C-9 | | 0.030 g |
| Coupler C-10 | | 0.40 g |

-continued

| | | |
|---|---|---|
| Compound Cpd-B | | 0.015 g |
| Compound Cpd-E | | 0.020 g |
| Compound Cpd-N | | 2.0 mg |
| Compound Cpd-T | | 0.010 g |
| Ultraviolet absorbent U-5 | | 0.015 g |
| Additive P-1 | | 0.030 g |
| W-3 | | 0.035 g |
| 16th layer: High-speed blue-sensitive emulsion layer | | |
| Emulsion N | silver amount | 0.40 g |
| Gelatin | | 2.00 g |
| Coupler C-8 | | 0.10 g |
| Coupler C-9 | | 0.15 g |
| Coupler C-10 | | 1.10 g |
| Coupler C-3 | | 0.010 g |
| High-boiling point organic solvent Oil-5 | | 0.020 g |
| Compound Cpd-B | | 0.060 g |
| Compound Cpd-D | | 3.0 mg |
| Compound Cpd-E | | 0.020 g |
| Compound Cpd-F | | 0.020 g |
| Compound Cpd-N | | 5.0 mg |
| Compound Cpd-T | | 0.070 g |
| Ultraviolet absorbent U-5 | | 0.060 g |
| Additive P-1 | | 0.10 g |
| W-3 | | 0.15 g |
| W-2 | | 0.050 g |
| 17th layer: 1st protective layer | | |
| Gelatin | | 0.70 g |
| Ultraviolet absorbent U-1 | | 0.020 g |
| Ultraviolet absorbent U-5 | | 0.030 g |
| Ultraviolet absorbent U-2 | | 0.10 g |
| Compound Cpd-B | | 0.030 g |
| Compound Cpd-O | | 5.0 mg |
| Compound Cpd-A | | 0.030 g |
| Compound Cpd-H | | 0.20 g |
| Dye D-1 | | 2.0 mg |
| Dye D-2 | | 3.0 mg |
| Dye D-3 | | 2.0 mg |
| Dye D-6 | | 2.0 mg |

-continued

| | | |
|---|---|---|
| High-boiling point organic solvent Oil-2 | | 0.020 g |
| High-boiling point organic solvent Oil-3 | | 0.030 g |
| W-3 | | 0.015 g |
| W-2 | | 5.0 mg |
| 18th layer: 2nd protective layer | | |
| Fine grain silver iodobromide emulsion (average grain diameter 0.06 μm AgI content 1 mole %) | silver amount | 0.10 g |
| Gelatin | | 0.80 g |
| Ultraviolet absorbent U-2 | | 0.030 g |
| Ultraviolet absorbent U-5 | | 0.030 g |
| High-boiling point organic solvent Oil-2 | | 0.010 g |
| W-3 | | 6.0 mg |
| 19th layer: 3rd protective layer | | |
| Gelatin | | 1.00 g |
| Polymethyl methacrylate (average grain diameter 1.5 μm) | | 0.10 g |
| 6:4 copolymer of methyl methacrylate and methacrylic acid (average grain diameter 1.5 μm) | | 0.15 g |
| Silicone oil SO-1 | | 0.20 g |
| Surfactant W-1 | | 0.010 g |
| Surfactant W-2 | | 0.040 g |

Other than the above-described compositions, additives F-1 to F-9 were added to all emulsion layers. Also, other than the above-described compositions, a gelatin hardener H-1 and surfactants for coating W-2 and W-4 were added to each layer. Furthermore, phenol, 1,2benzisothiazoline-3-one, 2-phenoxyethanol, phenethyl alcohol, and p-benzoic butyl ester were added as antiseptic and antimold agents. As for the thus prepared Sample 101, a coated film thickness in a dry state was 24.0 μm and a ratio of swelling when swelled with distilled water at 25° C. was 1.85 time.

TABLE 1

Structure of silver halide emulsion

| Emulsion | Characteristics | Average equivalent sphere diameter (μm) | Average aspect ratio | Variation coefficient | Average AgI content (%) | Halogen composition structure of silver halide grain | Average AgI content of grain surface (%) | Other characteristics(*) (1) | (2) | (3) | (4) | (5) | (6) |
|---|---|---|---|---|---|---|---|---|---|---|---|---|---|
| A | Monodisperse (III) tabular grain | 0.25 | 8 | 15 | 3.5 | Quadruple | 0.5 | | O | | O | O | |
| B | Monodisperse (III) tabular grain | 0.30 | 13 | 16 | 3.3 | Triple | 1.5 | | O | O | | | O |
| C | Monodisperse (III) tabular grain | 0.35 | 14 | 19 | 3.5 | Quintuple | 2.1 | | O | | | O | |
| D | Monodisperse (III) tabular grain | 0.60 | 13 | 18 | 2.0 | Triple | 1.0 | | O | | | O | |
| E | Monodisperse tetradecahedral grain | 0.18 | — | 10 | 4.5 | Triple | 1.5 | O | O | | O | | |
| F | Monodisperse (III) tabular grain | 0.23 | 15 | 13 | 4.0 | Double | 2.9 | | O | | | O | O |
| G | Monodisperse (III) tabular grain | 0.25 | 18 | 15 | 3.5 | Double | 3.0 | O | O | | | | O |
| H | Monodisperse (III) tabular grain | 0.37 | 21 | 14 | 2.5 | Quintuple | 1.9 | O | | | | | O |
| I | Monodisperse (III) tabular grain | 0.80 | 15 | 19 | 2.0 | Triple | 1.0 | O | O | | O | O | |
| J | Monodisperse (III) tabular grain | 0.30 | 16 | 18 | 2.7 | Quintuple | 2.0 | O | | O | | | O |
| K | Monodisperse (III) tabular grain | 0.37 | 15 | 15 | 3.5 | Triple | 1.8 | O | | | | | O |
| L | Monodisperse (III) tabular grain | 0.46 | 20 | 12 | 2.5 | Quadruple | 1.6 | O | O | | | | O |

TABLE 1-continued

| Structure of silver halide emulsion | | | | | | | | | | | | | |
|---|---|---|---|---|---|---|---|---|---|---|---|---|---|
| Emulsion | Characteristics | Average equivalent sphere diameter (μm) | Average aspect ratio | Variation coefficient | Average AgI content (%) | Halogen composition structure of silver halide grain | Average AgI content of grain surface (%) | Other characteristics(*) (1) | (2) | (3) | (4) | (5) | (6) |
| M | Monodisperse (III) tabular grain | 0.60 | 13 | 14 | 1.6 | Quintuple | 1.8 | O | O | | O | O | |
| N | Monodisperse (III) tabular grain | 1.00 | 13 | 18 | 1.3 | Quintuple | 1.0 | O | O | | | O | |

(*)Other characteristics (1) A reduction sensitizer was added during the grain formation. (2) A selenium sensitizer was used as an after-ripening agent.

(3) A rhodium salt was added during the grain formation.

(4) After the after-ripening, 10% of silver nitrate, in terms of silver molar ratio, based on the emulsion grains at the very moment and an equimolar amount of potassium bromide were added to perform a shell covering.

(5) The presence of 10 or more dislocation lines per grain on the average was observed through a transmission electron microscope.

All the photosensitive emulsions were after-ripened by using sodium thiosulfate, potassium thiocyanate and sodium chloroaurate. Further, an iridium salt was appropriately added during the grain formation. Still further, to each of the emulsions B, C, E, H, J and N, a chemically modified gelatin in which amino groups of gelatin were partially converted to phthalamides was added during the emulsion preparation.

(6) There was provided a grain in which a protruded portion is present in at least one of the apexes of the tabular grain.

TABLE 2-1

| Spectral sensitization of emulsions A to N | | | |
|---|---|---|---|
| Emulsion | Added sensitizing dye | Addition amount per mole of silver halide (g) | Addition timing of sensitizing dye |
| A | S-1 | 0.1 | During grain formation |
| | S-2 | 1.0 | During grain formation |
| B | S-1 | 0.5 | During grain formation |
| | S-2 | 1.1 | During grain formation |
| C | S-1 | 0.1 | During grain formation |
| | S-2 | 0.7 | During grain formation |

TABLE 2-1-continued

| Spectral sensitization of emulsions A to N | | | |
|---|---|---|---|
| Emulsion | Added sensitizing dye | Addition amount per mole of silver halide (g) | Addition timing of sensitizing dye |
| D | S-1 | 0.05 | Immediately after chemical sensitization |
| | S-2 | 0.6 | Immediately after chemical sensitization |
| | S-7 | 0.2 | Immediately after chemical sensitization |
| E | S-3 | 0.4 | During grain formation |
| | S-4 | 0.1 | During grain formation |
| F | S-3 | 1.1 | During grain formation |
| | S-4 | 0.3 | During grain formation |
| G | S-3 | 1.2 | During grain formation |
| | S-4 | 0.5 | During grain formation |
| H | S-3 | 1.0 | During grain formation |
| | S-4 | 0.3 | During grain formation |
| I | S-3 | 0.9 | Immediately before start of chemical sensitization |
| | S-4 | 0.3 | Immediately before start of chemical sensitization |
| | S-8 | 0.1 | Immediately before start of chemical sensitization |
| J | S-6 | 1.0 | During grain formation |
| | S-5 | 0.4 | During grain formation |
| K | S-6 | 1.2 | During grain formation |
| | S-5 | 0.6 | During grain formation |

TABLE 2-2

| Spectral sensitization of emulsions A to N | | | |
|---|---|---|---|
| Emulsion | Added sensitizing dye | Addition amount per mole of silver halide (g) | Addition timing of sensitizing dye |
| L | S-6 | 0.8 | During grain formation |
| | S-5 | 0.4 | During grain formation |
| M | S-6 | 0.8 | Immediately after chemical sensitization |
| | S-5 | 0.5 | Immediately after chemical sensitization |
| N | S-6 | 0.9 | Immediately after completion of grain formation |
| | S-5 | 0.3 | Immediately after completion of grain formation |

TABLE 2-2-continued
| Spectral sensitization of emulsions A to N |
| --- |
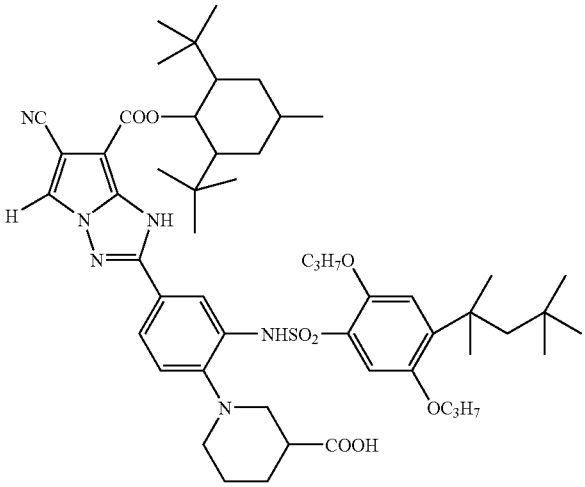
C-1
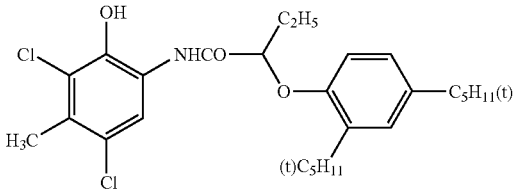
C-2
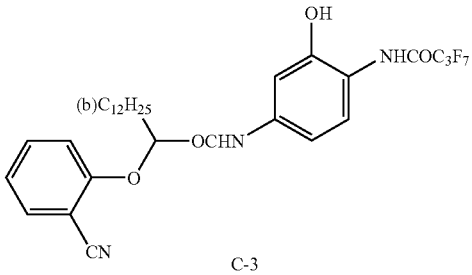
C-3
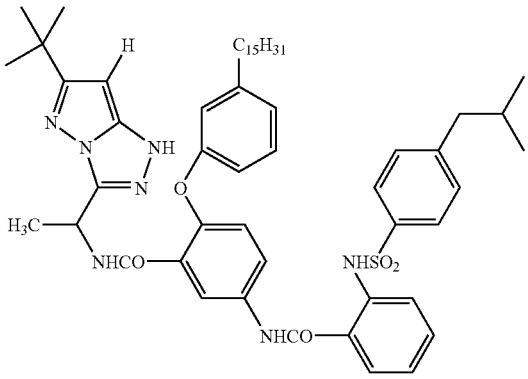
C-4

TABLE 2-2-continued
| Spectral sensitization of emulsions A to N |
|---|
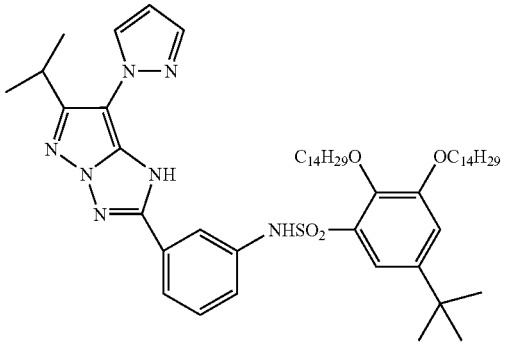
C-5
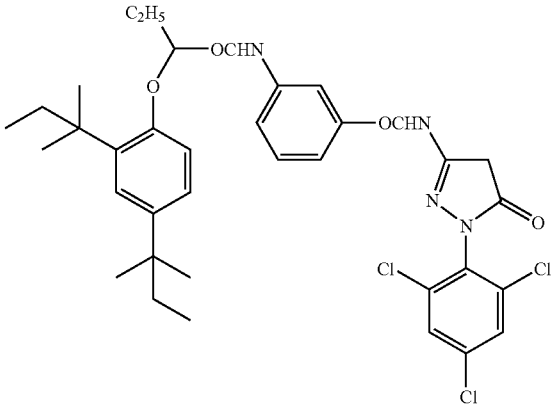
C-6
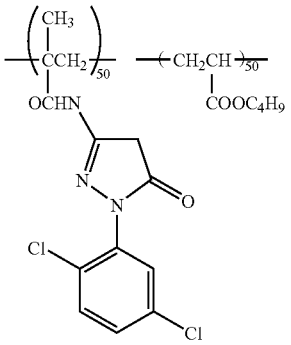
Numerals are shown in mass %; and Average molecular weight: approximately 25,000
C-7
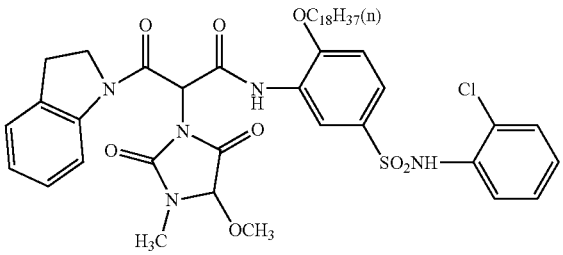
C-8

TABLE 2-2-continued
Spectral sensitization of emulsions A to N
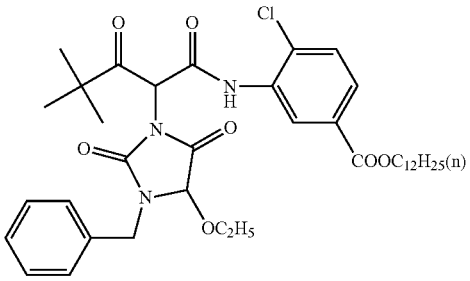
C-9
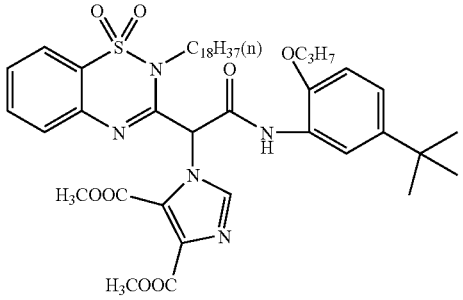
C-10
Oil-1: Tri-n-hexyl phosphate
Oil-2: Tricresyl phosphate
Oil-3:
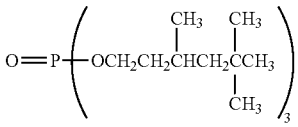
Oil-4: Tricyclohexyl phosphate
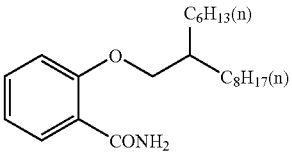
Oil 5
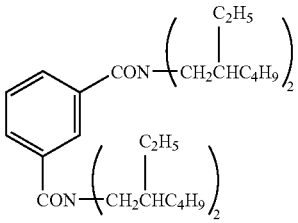
Oil 6
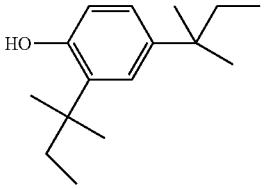
Oil 7
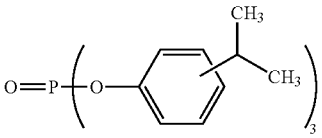
Oil 8 (Mixture of isomers)
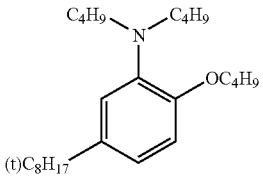
Oil-9
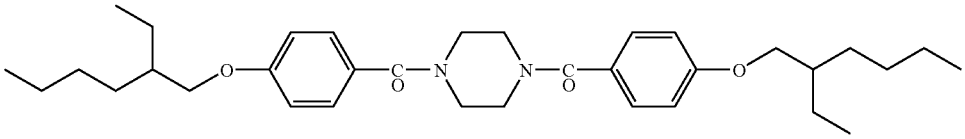
Oil 10

TABLE 2-2-continued
| Spectral sensitization of emulsions A to N |
|---|
| 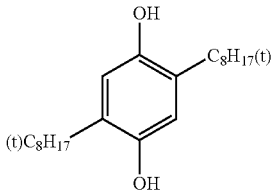 Cpd-A |
| 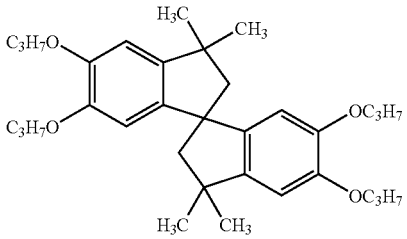 Cpd-B |
| 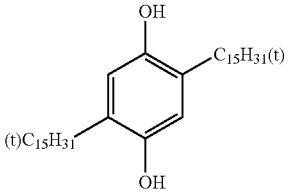 Cpd-C |
| 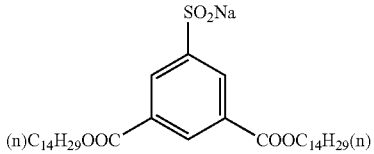 Cpd-D |
| 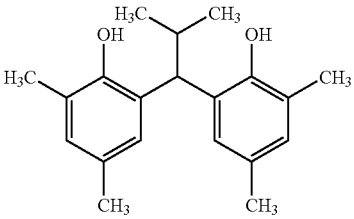 Cpd-E |
| 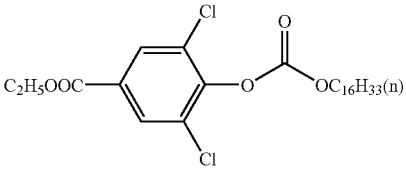 Cpd-F |
| 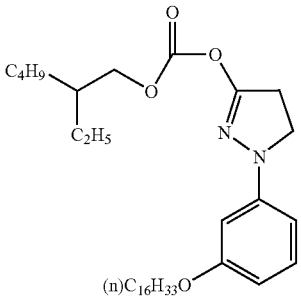 Cpd-G |
| 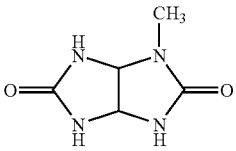 Cpd-H |
| 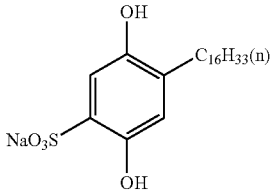 Cpd-I |
| 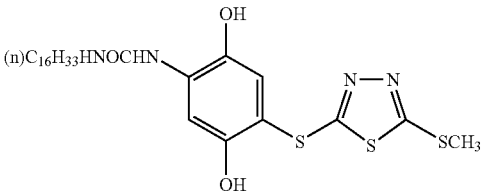 Cpd-J |

TABLE 2-2-continued
| Spectral sensitization of emulsions A to N |
|---|
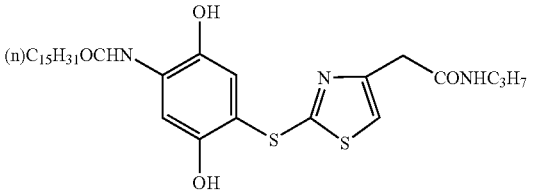
Cpd-K
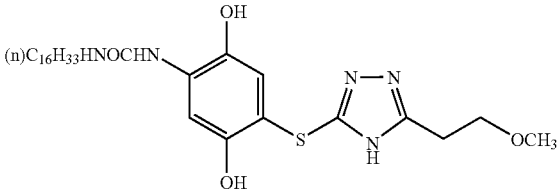
Cpd-L
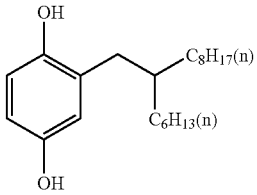
Cpd-M
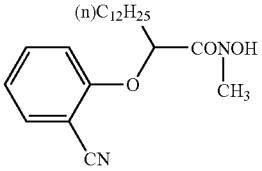
Cpd-N
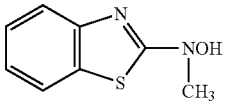
Cpd-O
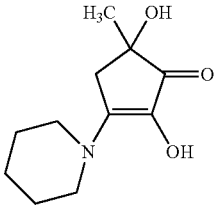
Cpd-P
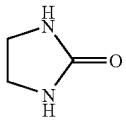
Cpd-Q
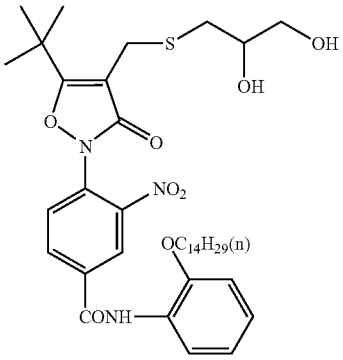
Cpd-R
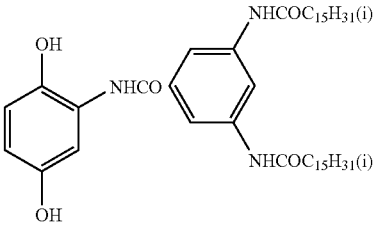
Cpd-S TABLE 2-2-continued
| Spectral sensitization of emulsions A to N |
|---|
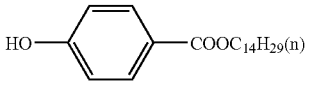
Cpd-T
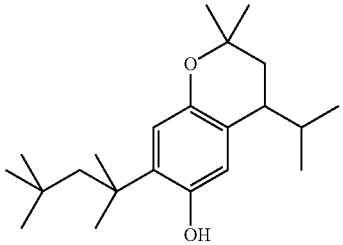
Cpd-U
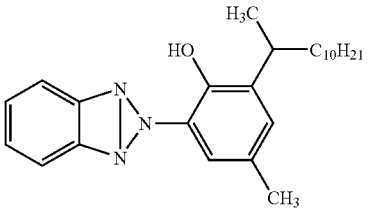
U-1
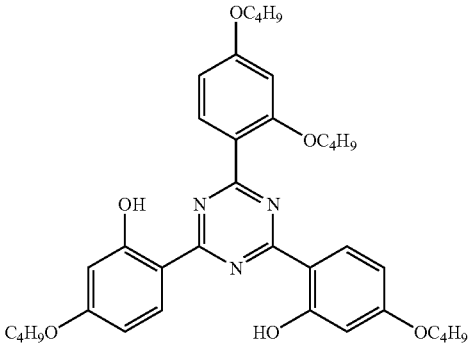
U-2
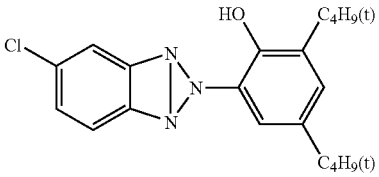
U-3
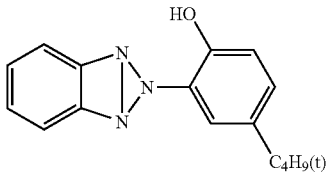
U-4
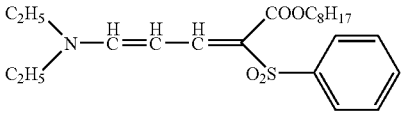
U-5
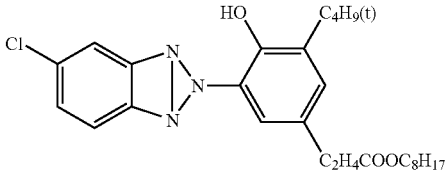
U-6
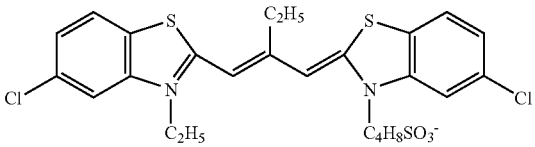
S-1

TABLE 2-2-continued
| Spectral sensitization of emulsions A to N |
|---|
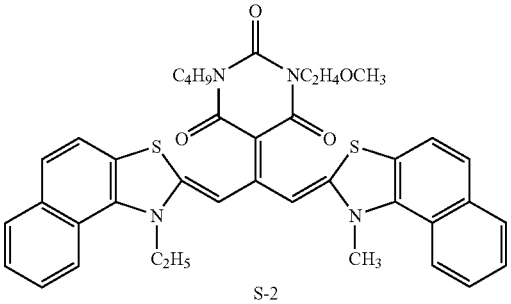
S-2
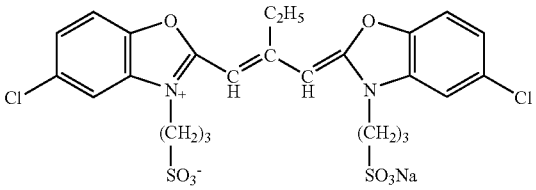
S-3
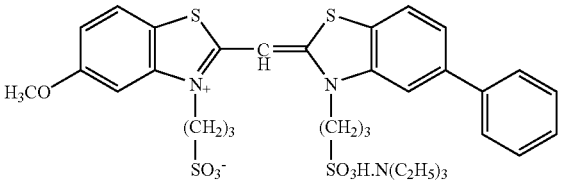
S-4
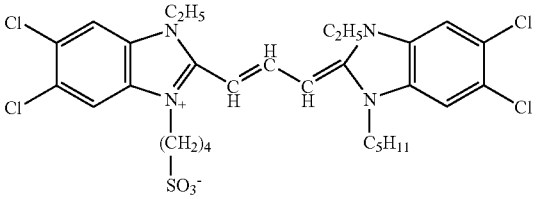
S-5
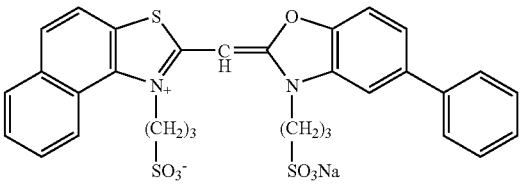
S-6
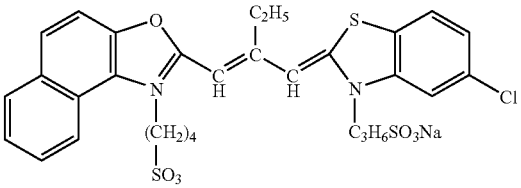
S-7

TABLE 2-2-continued
Spectral sensitization of emulsions A to N
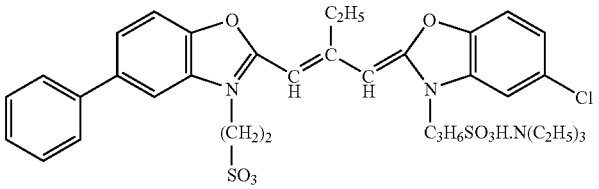
S-8
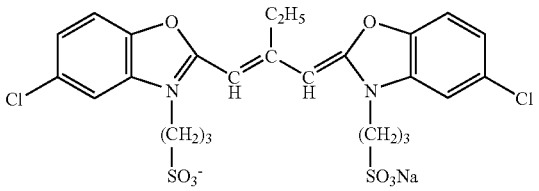
S-9: Same as S-3
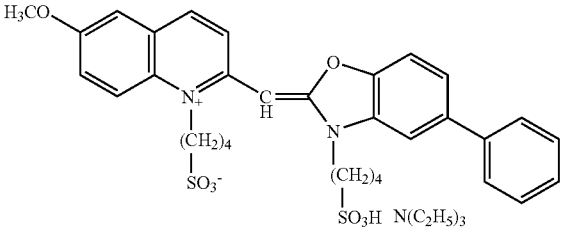
S-10
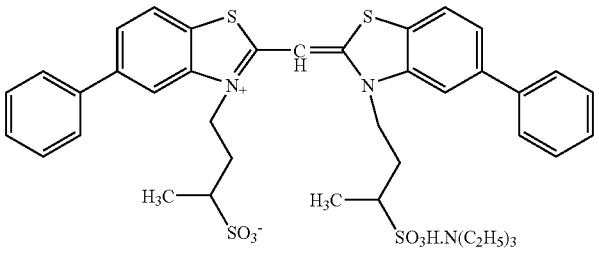
S-11
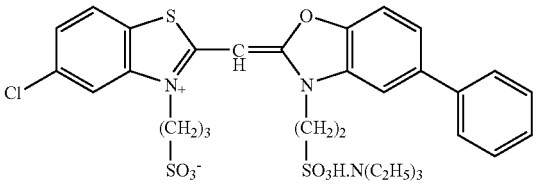
S-12
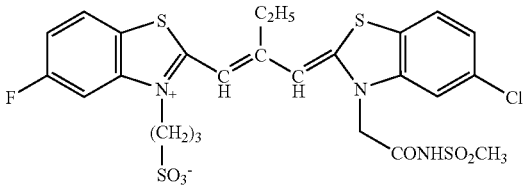
S-13

TABLE 2-2-continued
| Spectral sensitization of emulsions A to N |
|---|
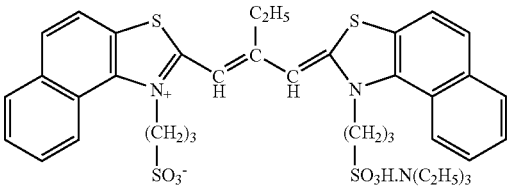
S-14
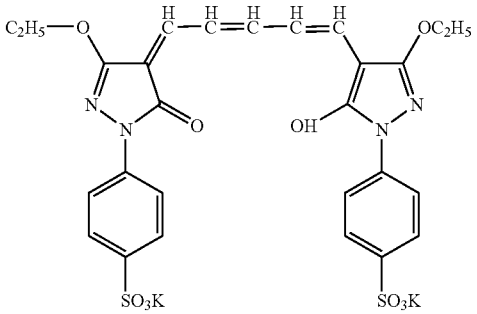
D-1
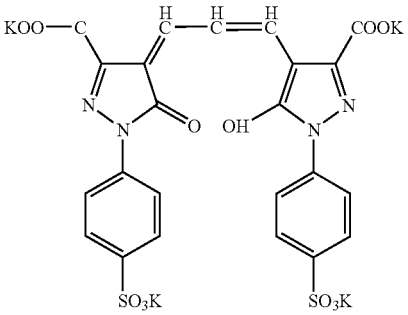
D-2
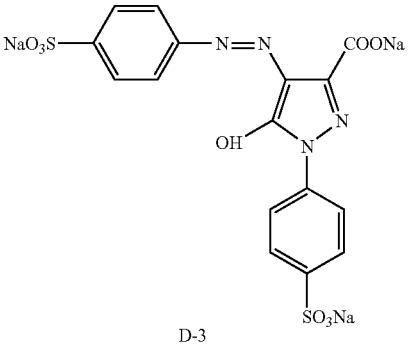
D-3
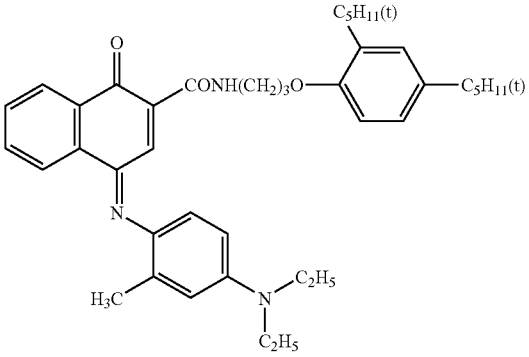
D-4

TABLE 2-2-continued
| Spectral sensitization of emulsions A to N |
|---|
| 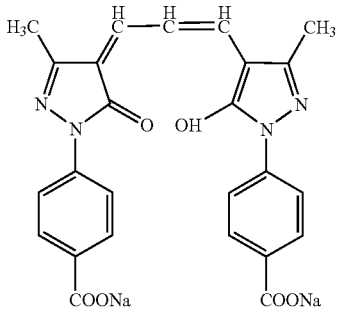 D-5 |
| 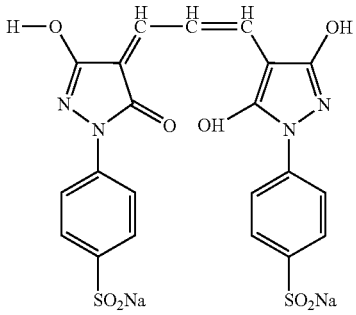 D-6 |
| 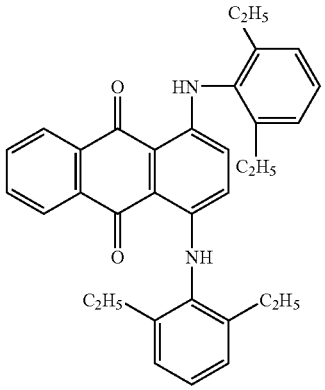 D-7 |
| 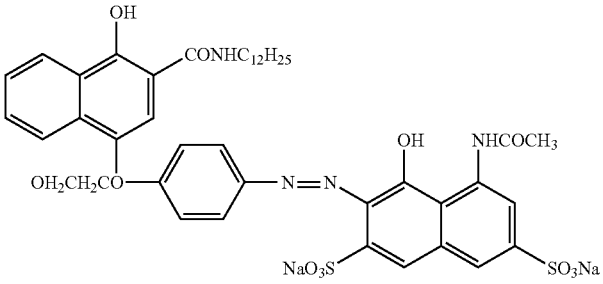 D-8 |
| 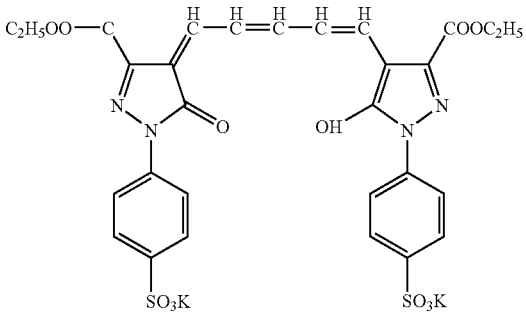 D-9 |

TABLE 2-2-continued
| Spectral sensitization of emulsions A to N |
|---|
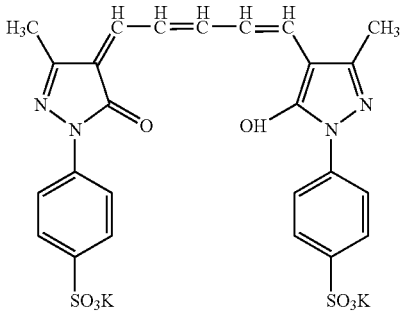
D-10
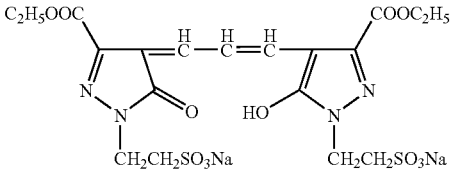
D-11
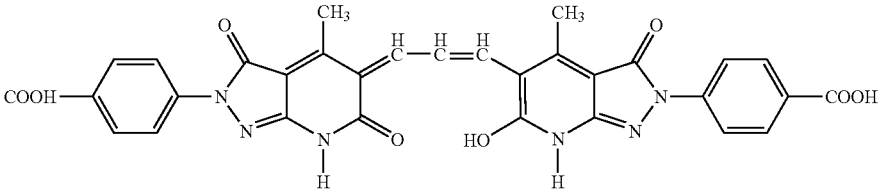
E-1
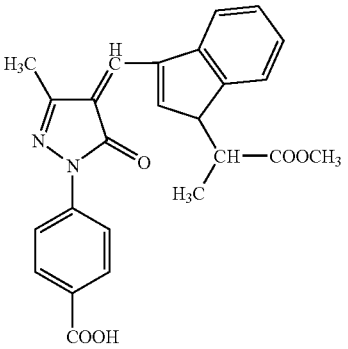
E-2
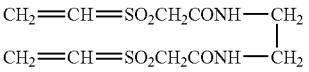
H-1
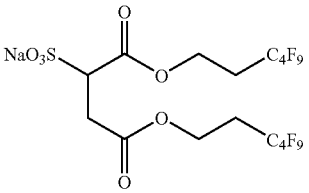
W-1
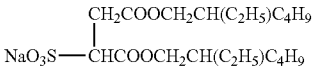
W-2

TABLE 2-2-continued
| Spectral sensitization of emulsions A to N |
|---|
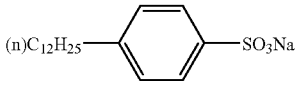
W-4
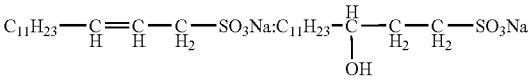
Mixture(60%:40%)
W-5
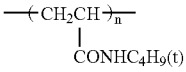
(n = 100~1000)
P-1
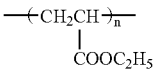
(n = 100~1000)
P-2
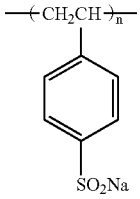
(n = 100~1000)
P-3
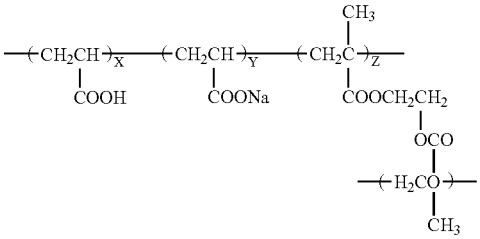
(X:Y:Z = 42.5:7.5:50)
P-4
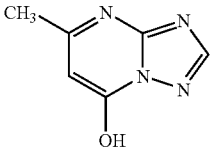
F-1
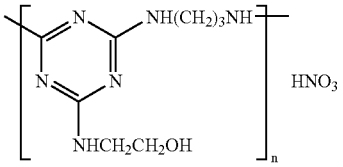
n = 3~4
F-2
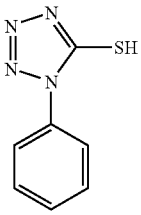
F-3
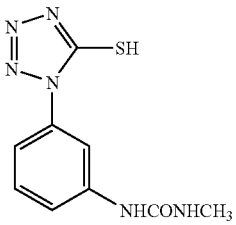
F-4
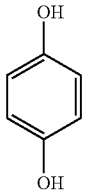
F-5
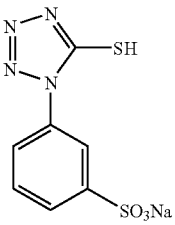
F-6

TABLE 2-2-continued

| Spectral sensitization of emulsions A to N | |
|---|---|
| 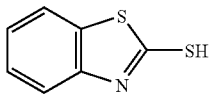 F-7 | 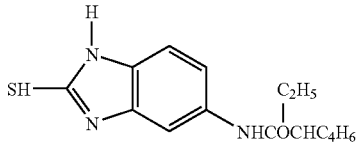 F-8 |
| 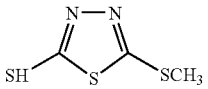 F-9 | 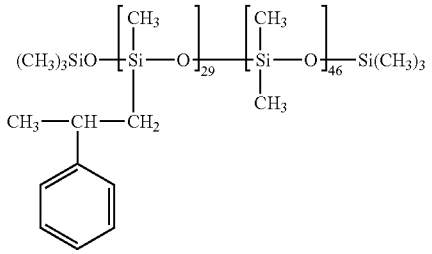 SO-1 |

Preparation of Dispersion of Organic Solid Disperse Dye (Preparation of Dispersion of Dye E-1)

15 g of w-5 and water were added to a wet cake of the dye E-1 (net weight of E-1 being 270 g), and stirred to make 4,000 g. Next, the Ultra Visco Mill (UVM-2) manufactured by Imex K.K. was loaded with 1,700 mL of zirconia beads having an average particle diameter of 0.5 mm, and the slurry was pulverized through the UVM-2 at a peripheral speed of approximately 10 m/sec and a discharge rate of 0.5 L/min for two hours. The beads were filtered out, and water was added to dilute the resultant mixture to form a dye dispersion having a concentration of 3%. After that, the dispersion was heated at 90° C. for 10 hours for stabilization. An average particle diameter of the resultant dye fine particles was 0.25 μm, and the particle diameter distribution (particle diameter standard deviation×100/average particle diameter) was 20%.

(Preparation of Solid Dispersion of Dye E-2)

Water and 270 g of W-5 were added to 1,400 g of a wet cake of E-2 containing 30% by mass of water, and the resultant mixture was stirred to form a slurry having an E-2 concentration of 40% by mass. Next, the Ultra Visco Mill (UVM-2) manufactured by Imex K.K. was loaded with 1,700 mL of zirconia beads having an average particle diameter of 0.5 mm, and the slurry was pulverized through the UVM-2 at a peripheral speed of approximately 10 m/sec and a discharge rate of 0.5 L/min for 8 hours, thereby obtaining a solid fine particle dispersion of E-2. This dispersion was diluted to 20% by mass by using ion-exchanged water to obtain a solid fine particle dispersion. The average particle diameter was 0.15 μm.

Next, surfactants W-3 and W-2 which had been used in emulsifying each layer of the sample 101 were changed into those as described in Table 3 and, also, as described in Table 3, a non-color-forming photosensitive emulsion layer was introduced to prepare samples 102 to 111. At the time of changing surfactants, an total mass of the surfactants to replace W-3 and W-2 was allowed to be the same as that of W-3 and W-2. A detail of such newly introduced layer is shown in Table 3.

TABLE 3

| | | Structure of Sample | | | |
|---|---|---|---|---|---|
| | | Non-color-forming photosensitive emulsion layer | | | |
| Sample | | Position | Emulsion | Silver amount/ gelatin amount | Change of surfactant |
| 101 | Comparative Example | None | | | |
| 102 | Comparative Example | Between layers 17 and 18 | Emulsion-IA | 0.1 g/0.3 g | Same as 101 |
| 103 | Comparative Example | None | | | K-3 |
| 104 | Present Invention | Between layers 17 and 18 | Emulsion-IA | 0.1 g/0.3 g | K-3 |
| 105 | Comparative Example | Between layers 3 and 4 | Emulsion-IB | 0.25 g/0.5 g | Same as 101 |

TABLE 3-continued

| Sample | | Structure of Sample: Non-color-forming photosensitive emulsion layer: Position | Emulsion | Silver amount/ gelatin amount | Change of surfactant |
|---|---|---|---|---|---|
| 106 | Present Invention | Between layers 3 and 4 | Emulsion-IB | 0.25 g/0.5 g | K-3 |
| 107 | Comparative Example | Between layers 13 and 14 | Emulsion-IC | 0.1 g/0.4 g | Same as 101 |
| 108 | Present Invention | Between layers 13 and 14 | Emulsion-IC | 0.1 g/0.4 g | K-3 |
| 109 | Comparative Example | Between layers 3 and 4<br>Between layers 3 and 4<br>Between layers 13 and 14 | Emulsion-IB<br>Emulsion-ID<br>Emulsion-IC | 0.25 g/0.5 g<br>0.1 g/0.3 g<br>0.1 g/0.3 g | Same as 101 |
| 110 | Present Invention | Between layers 3 and 4<br>Between layers 3 and 4<br>Between layers 13 and 14 | Emulsion-IB<br>Emulsion-ID<br>Emulsion-IC | 0.25 g/0.5 g<br>0.1 g/0.3 g<br>0.1 g/0.3 g | K-8 |
| 111 | Present Invention | Between layers 3 and 4<br>Between layers 17 and 18 | Emulsion-IB<br>Emulsion-IA | 0.2 g/0.4 g<br>0.1 g/0.3 g | K-8 |

The resultant samples 101 to 111 were cut into 40 sheets in a rectangular shape of 10 cm long and 12.5 cm wide and, then, subjected to an uniform exposure such that each sample had a gray density in the range of from 0.7 to 1.0 and, thereafter, subjected to a development processing-A as described below. As for a bath for development processing, a 2L-capacity tank made of stainless steel was used, and development was performed on 4 pieces at a time therein, accordingly, performed 10 times in total. A development solution was not replenished with a replenishing solution until all of the 40 sheets of samples were processed. The pipe having small hole was provided at the bottom of the respective tanks to blow nitrogen gas for stirring. Samples 101 to 107 were processed in the same processing manner. Appearance and state of bubbling of the developing solution after 40 sheets of samples were subjected to running processing, and unevenness of 4 sheets of samples which were processed at a 10th time of the processing in order were visually observed.

| Processing step | Time | Temperature |
|---|---|---|
| First development | 6 min | 38° C. |
| First washing | 2 min | 38° C. |
| Reversal | 2 min | 38° C. |
| Color development | 6 min | 38° C. |
| Pre-bleaching | 2 min | 38° C. |
| Bleaching | 6 min | 38° C. |
| Fixing | 4 min | 38° C. |
| 2nd washing | 4 min | 38° C. |
| Final rinsing | 1 min | 25° C. |

The compositions of the processing solutions were as follows:

| | <Tank solution> |
|---|---|
| <First developing solution> | |
| Nitrilo-N,N,N-trimethylene phosphonic acid pentasodium salt | 1.5 g |
| Diethylenetriamine pentaacetic acid pentasodium salt | 2.0 g |
| Sodium sulfite | 30 g |
| Hydroquinone potassium monosulfonate | 22 g |
| Potassium carbonate | 15 g |
| Potassium bicarbonate | 12 g |
| l-phenyl-4-methyl-4-hydroxymethyl-3-pyrazolidone | 1.2 g |
| Potassium bromide | 3.0 g |
| Potassium thiocyanate | 1.2 g |
| Potassium iodide | 4.0 mg |
| Water as required, to make the total up to | 1,000 mL |
| pH | 9.65 |
| The pH was adjusted by using sulfuric acid or potassium hydroxide. | |
| <Reversal solution> | |
| Nitrilo-N,N,N-trimethylene phosphonic acid pentasodium salt | 3.0 g |
| Stannous chloride dehydrate | 1.0 g |
| Sodium hydroxide | 8 g |
| Glacial acetic acid | 15 mL |
| Water as required, to make the total up to | 1,000 mL |
| pH | 5.90 |
| The pH was adjusted by using acetic acid or sodium hydroxide. | |
| <Color-forming developing solution> | |
| Nitrilo-N,N,N-trimethylene phosphonic acid pentasodium salt | 2.0 g |
| Sodium sulfite | 5.7 g |
| Dibasic potassium phosphate | 22 g |
| Sodium bromide | 0.5 g |
| Potassium iodide | 30 mg |
| Sodium hydroxide | 14.0 g |
| Citrazinic acid | 0.4 g |

-continued

| | <Tank solution> |
|---|---|
| N-ethyl-N-(β-methanesulfonamidoethyl)-3-methyl-4aminoaniline 3/2 sulfuric acid monohydrate | 8 g |
| 3,6-dithiaoctane-1,8-diol | 0.6 g |
| Water as required, to make the total up to | 1,000 mL |
| pH | 11.90 |
| The pH was adjusted by using sulfuric acid or potassium hydroxide. | |
| <Pre-bleaching solution> | |
| Ethylenediamine tetraacetic acid disodium salt dehydrate | 8.0 g |
| Sodium sulfite | 6.0 g |
| 1-thioglycerol | 0.4 g |
| Formaldehyde sodium bisulfite adduct | 25 g |
| Water as required, to make the total up to | 1,000 mL |
| pH | 6.3 |
| The pH was adjusted by using acetic acid or sodium hydroxide. | |
| <Bleaching solution> | |
| Ethylenediamine tetraacetic acid disodium salt dehydrate | 2.0 g |
| Ethylenediamine tetraacetic acid Fe(III) ammonium dehydrate | 120 g |
| Potassium bromide | 100 g |
| Ammonium nitrate | 10 g |
| Water as required, to make the total up to | 1,000 mL |
| pH | 5.70 |
| The pH was adjusted by using nitric acid or sodium hydroxide. | |
| <Fixing solution> | |
| Ammonium thiosulfate | 80 g |
| Sodium sulfite | 5.0 g |
| Sodium bisulfite | 5.0 g |
| Water as required, to make the total up to | 1,000 mL |
| pH | 6.60 |
| The pH was adjusted by using acetic acid or ammonia water. | |
| <Stabilizer> | |
| 1,2-benzoisothiazoline-3-one | 0.02 |
| Polyoxyethylene-p-monononyl phenyl ether (average polymerization degree: 10) | 0.3 g |
| Polymaleic acid (weight-average molecular weight: 2,000) | 0.1 g |
| Water as required, to make the total up to | 1,000 mL |
| PH | 7.0 |

Evaluation of Sample (Evaluation of Bubbling)

In regard to the first developing solution in which samples 101 to 111 were subjected to running processing, generation of bubbles was continuously performed for 30 seconds by blowing nitrogen gas from the bottom of the tank and, then, such generation was stopped. A time duration of from such stopping to disappear of the thus-generated bubbles was measured. It is preferable that the time duration is shorter, bubbling is smaller or disappearance of the thus-generated bubbles is quicker. The results are shown in Table 4.

(Evaluation of Processing Unevenness)

In regard to 4 pieces of samples which were subjected to running processing at tenth in order, state of occurrence of processing unevenness of the samples was evaluated. In this processing, bubbling of the first developing solution was continuously performed for 30 seconds to generate bubbles on a surface of the solution and, then, processing was performed. Evaluation was performed according to a sensory analysis method under the criterion of 3-stage evaluation, namely, "no unevenness was observed, which is marked "A"; "there was bubble-like unevenness, which is marked "B"; and "there are many bubble-like unevenness, which is marked "C" Further, when a black spot-like unevenness (number of 4 pieces in total) was observed, a special note was added to the results. The results are shown in Table 4.

TABLE 4

Result of Evaluation

| Sample | | Time until disappear of bubble | Processing unevenness (number of black spot) |
|---|---|---|---|
| 101 | Comparative Example | 7 min | B (2 spots) |
| 102 | Comparative Example | 7.5 min | C (4 spots) |
| 103 | Comparative Example | 2 min | A |
| 104 | Present Invention | 2 min | A |
| 105 | Comparative Example | 8 min | C (5 spots) |
| 106 | Present Invention | 2 min | A |
| 107 | Comparative Example | 8 min | C (4 spots) |
| 108 | Present Invention | 2 min | A |
| 109 | Comparative Example | 7 min | C (6 spots) |
| 110 | Present Invention | 1.5 min | A |
| 111 | Present Invention | 1.5 min | A |

As has been described above, when a non-color-forming photosensitive emulsion layer was provided without employing the surfactant according to the invention, processing unevenness occurred. In contrast to this, in the samples in which the surfactant according to the invention was used, the processing unevenness was improved and black spot-like unevenness was not observed. In such samples as described above, bubble generation of the developing solution after running processing was very little. Under these circumstances, it can be assumed that the processing unevenness was reduced.

According to the invention, a silver halide photographic photosensitive material, particularly, a silver halide color photographic photosensitive material which has excellent color reproduction property, and reduced generation of unevenness during developing processing can be provided.

What is claimed is:

1. A silver halide photographic photosensitive material, comprising a support and at least one photosensitive silver halide emulsion layer on the support, wherein the silver halide photographic photosensitive material comprises at least one layer comprising an emulsion containing at least one surfactant represented by the following formula (I), and the silver halide photographic photosensitive material contains a substantially non-color-forming photosensitive emulsion layer:

$$(R_1—L)_n\text{-J-}(A)_m \qquad (I),$$

wherein A represents an acid group selected from the group consisting of a sulfonic acid, a phosphoric acid, a carboxylic acid and metal salts thereof;

$R_1$ represents an aliphatic group including as a partial structure thereof an aliphatic group whose main chain has at least 6 carbon atoms;

L represents a divalent group;

J represents a linking group, having a valence of n plus m, which links $R_1$—L and A;

n represents a natural number of from 1 to 6; and m represents a natural number of from 1 to 3, wherein, when n represents 2 or more, plural ($R_1$—L) groups present may be the same as each other or different from one another, wherein, when m represents 2 or more, plural A groups present may be the same as each other or different from one another; a sum of carbon atoms of $R_1$ (when n is 2 or more, a sum of the carbon atoms in all $R_1$ groups) is 17 or more; and a value obtained by dividing a molecular weight of the surfactant (in the case of a metal salt, the molecular weight obtained by substituting the metal atom with a hydrogen atom) represented by the formula (I) by m is 430 or more.

2. The silver halide photographic photosensitive material according to claim 1, wherein A in the formula (I) represents a sulfonic acid or a metal salt thereof.

3. The silver halide photographic photosensitive material according to claim 1, wherein $R_1$ in the formula (I) represents an aliphatic group including as a partial structure thereof an aliphatic group whose main chain has at least 12 carbon atoms.

4. The silver halide photographic photosensitive material according to claim 1, wherein L in the formula (I) represents one group selected from the group consisting of: —$CHR_2$—, —O—, —CO—, —COO— and —$CONR_2$—; wherein $R_2$ is a hydrogen atom or an alkyl group.

5. The silver halide photographic photosensitive material according to claim 1, wherein n in the formula (I) represents an integer of from 2 to 6.

6. The silver halide photographic photosensitive material according to claim 1, wherein m in the formula (I) represents 1.

7. The silver halide photographic photosensitive material according to claim 1, wherein a sum of carbon atoms of $R_1$ in the formula (I) is in the range of from 24 to 50.

8. The silver halide photographic photosensitive material according to claim 1, wherein a value to be obtained by dividing a molecular weight of the surfactant (in the case of metal salt, the molecular weight obtained by substituting the metal atom with a hydrogen atom) as represented by the formula (I) by m is in the range of from 470 to 900.

9. The silver halide photographic photosensitive material according to claim 1, wherein the surfactant represented by the formula (I) is represented by the following formula (II):

$$(R_1—L_2)_k J\text{-}SO_3M \quad \text{(II)},$$

wherein $R_1$ represents an aliphatic group including as a partial structure thereof an aliphatic group in which a main chain has at least 6 carbon atoms;

$L_2$ represents a divalent group selected from the group consisting of: —O—, —CO— and —O—CO— (being bonded with $R_1$ at the left side of the group);

k represents 2 or 3;

J represents a linking group of (k+1) valence, wherein J does not contain an aryl group;

M represents a hydrogen atom or a metal atom; wherein a sum of carbon atoms of $R_1$ in a portion represented by $(R_1—L_2)k$ is 17 or more; and a molecular weight of the compound represented by the formula (II) (in the case of M being a hydrogen atom) is 430 or more.

10. The silver halide photographic photosensitive material according to claim 1, wherein the surfactant represented by the formula (I) is represented by the following formulae (III) or (IV):

(III)

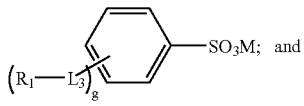

(IV)

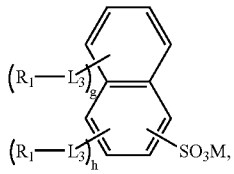

wherein $R_1$ represents an aliphatic group including as a partial structure thereof an aliphatic group whose main chain has at least 6 carbon atoms;

$L_3$ represents a divalent group selected from the group consisting of: —$CHR_2$—, —O—, —CO—, —COO—, —OCOO—, —$CONR_2$—, $NR_2CONR_3$—, —$SO_2$—, —$SO_2NR_2$— and S—;

$R_2$ and $R_3$ each independently represent a hydrogen atom or an alkyl group;

g represents a natural number of from 1 to 4; and h represents a natural number of from 1 to 3.

11. The silver halide photographic photosensitive material according to claim 1, further comprising a photosensitive silver halide emulsion grain.

12. The silver halide photographic photosensitive material according to claim 1, wherein the silver halide grain comprises a hole-trapping zone within the grain.

* * * * *